US009725916B2

(12) United States Patent
McLain et al.

(10) Patent No.: US 9,725,916 B2
(45) **Date of Patent: *Aug. 8, 2017**

(54) SAFETY BAND LONGITUDINAL AND TRANSVERSE CONTROL

(71) Applicants: Michael J. McLain, Green Bay, WI (US); Timothy Pendley, Madera, CA (US)

(72) Inventors: Michael J. McLain, Green Bay, WI (US); Timothy Pendley, Madera, CA (US)

(73) Assignee: MATE, LLC, Green Bay, WI (US)

( * ) Notice: Subject to any disclaimer, the term of this patent is extended or adjusted under 35 U.S.C. 154(b) by 184 days.

This patent is subject to a terminal disclaimer.

(21) Appl. No.: 14/205,107

(22) Filed: Mar. 11, 2014

(65) Prior Publication Data

US 2015/0259934 A1 Sep. 17, 2015

(51) Int. Cl.
*E04G 21/32* (2006.01)
*E04B 7/00* (2006.01)
(Continued)

(52) U.S. Cl.
CPC ..... *E04G 21/3261* (2013.01); *E04B 7/024* (2013.01); *E04D 12/002* (2013.01);
(Continued)

(58) Field of Classification Search
CPC ..... E04G 21/3204; E04G 21/3214; E04G 21/3266; E04G 21/3261; E04D 13/1625; E04B 7/024
See application file for complete search history.

(56) References Cited

U.S. PATENT DOCUMENTS 3,969,863 A * 7/1976 Alderman ..... E04D 3/3602 52/407.4
4,047,345 A * 9/1977 Alderman ..... E04D 3/3601 52/404.1

(Continued)

FOREIGN PATENT DOCUMENTS

WO 2012145783 11/2012

OTHER PUBLICATIONS

Guardian Energy Saver FP, printed from internet Aug. 4, 2014, 23 pages.

(Continued)

*Primary Examiner* — Robert Canfield
(74) *Attorney, Agent, or Firm* — Thomas D. Wilhelm; Northwind IP Law, S.C.

(57) ABSTRACT

This invention provides fall protection systems comprising a suspension fabric, supported by a grid-work of longitudinal and lateral bands, in metal building construction. The fall protection system uses the combination of relatively softer banding, a safety band spaced a particular distance from each rafter, and safety clips to attach the safety bands to the intermediate purlins, thus to distribute the force of impact of a load, falling close to a rafter, to better absorb and dissipate the force of the impact, including distributing the impact of the falling load over a greater area of the roof structure. The invention further provides methods of making elements of such systems, methods of installing elements of such systems, and buildings embodying such systems.

31 Claims, 23 Drawing Sheets

(51) Int. Cl.

| | |
|---|---|
| ***E04B 7/02*** | (2006.01) |
| ***E04D 12/00*** | (2006.01) |
| ***E04D 13/16*** | (2006.01) |
| ***E04D 15/06*** | (2006.01) |

(52) U.S. Cl.
CPC ..... *E04D 13/1625* (2013.01); *E04D 15/06* (2013.01); *E04G 21/3266* (2013.01)

(56) References Cited

U.S. PATENT DOCUMENTS

| | | | | |
|---|---|---|---|---|
| 4,047,346 | A | | 9/1977 | Alderman |
| 4,446,664 | A | | 5/1984 | Harkins |
| 4,573,298 | A | | 3/1986 | Harkins |
| 4,875,320 | A | | 10/1989 | Sparkes |
| 5,201,152 | A | | 4/1993 | Heffner |
| 5,251,415 | A | | 10/1993 | Van Auken et al. |
| 5,406,764 | A | | 4/1995 | Van Auken et al. |
| 5,901,518 | A | | 5/1999 | Harkins |
| 5,953,875 | A | | 9/1999 | Harkins |
| 6,094,883 | A | | 8/2000 | Atkins |
| 6,226,945 | B1 | | 5/2001 | Henry et al. |
| 6,247,277 | B1 | | 6/2001 | Kerpash, Sr. |
| 6,401,426 | B1 | | 6/2002 | Alderman et al. |
| 6,748,715 | B1 | | 6/2004 | Black et al. |
| D625,581 | S | * | 10/2010 | Crostic, Jr. ..... D8/356 |
| 8,590,245 | B2 | | 11/2013 | Peng et al. |
| 2002/0020584 | A1 | | 2/2002 | Cjepa |
| 2003/0114055 | A1 | | 6/2003 | Burton et al. |
| 2011/0067345 | A1 | | 3/2011 | Crostic, Jr. et al. |
| 2012/0174502 | A1 | | 7/2012 | Oberg |
| 2013/0108377 | A1 | | 5/2013 | Steffenino |
| 2013/0305623 | A1 | | 11/2013 | Pendley et al. |

OTHER PUBLICATIONS

Guardian Energy Saver FP, Roof System Installation Instructions, 2009, 4 pages Guardian Building Products Distribution, Inc., Solon, Ohio.

Silvercote Lamination, ES Energy Saver FP, brochure, Copyright 2014, 20 pages, Silvercote Laminations, Greer, South Carolina.

Guardian Building Products Distribution, Inc., Guardian ES Energy Saver FP, Product Specification Sheet, Copyright 2011, 2 pages, Guardian Building Products, Greer, South Carolina.

Harris Steel, Industry properties for Steel Sheets—Cold Rolled & Hot Dipped Zinc Coated, Specification Sheet, First Received Feb. 2015, 2 pages, Harris Steel.

Steelscape, A Bluescope Steel Company, Zincalume Steel Grade 50 (Class 1), Grade Data Sheet, Jul. 1, 2012, 1 page, Steelscape.

Steelscape, A Bluescope Steel Company, Zincalume Steel Grade 80 (Class 1), Grade Data Sheet, Jul. 1, 2012, 1 page, Steelscape.

Maple Leaf Sales, K-Grip 514 Flammable Foam, Product Data Sheet, received Feb. 3, 2014, 1 page.

Maple Leaf Sales II, Inc., 514 Macroplast Adhesive, Material Safety Data Sheet, dated Jul. 16, 2010, 3 pages.

* cited by examiner

SAFETY BAND LONGITUDINAL AND TRANSVERSE CONTROL

BACKGROUND OF THE INVENTION

This invention relates to buildings, building components, building subassemblies, and building assemblies, and to methods of constructing buildings and building components. This invention relates specifically to components, subassemblies, and to assemblies, as parts of the building, to methods of making and using building components in the process of constructing buildings, and to the issue of worker safety during the construction of buildings.

From time to time, injuries occur during construction of buildings, including to workers who fall from elevated heights. The focus of this invention is to enable a building contractor to reduce, desirably to eliminate, the number of incidents of worker injuries resulting from workers falling from elevated heights while working on construction of the building.

When a worker falls, and travels some distance before impacting a support, the force of the impact has two parts. The first part impact force is the static force of gravity on the person's body. The second part of the impact force is the kinetic energy related to the velocity of the moving body.

In order for a fall protection system to work, such system must be able to arrest the person's fall, and be able to subsequently sustain support of the person's weight until the person can be retrieved, removed from the fall protection system. In most falls, the controlling requirement is that the system be able to arrest and dissipate the kinetic energy associated with the falling body without the body passing through the fall protection system.

Governmental safety organizations, for example the Occupational Safety and Health Administration (OSHA) in the US, have promulgated required safety standards, and safety practices to generally provide safety systems which capture and support workers who are working at substantial heights above supporting surfaces, to protect such workers, namely to stop a fall, and to support such workers if/when such workers fall. But it is up to the industry to create fall protection systems which meet the required, standards.

With pre-engineered building systems now being the predominant method of non-residential low rise construction for buildings, existing fall protection standards have substantial impact on the contractors involved.

One way a worker can be protected, according to the standards, is for the worker to wear a safety harness which is tied, by a strap, to the building structure such that the harness/strap combination stops any fall which the worker experiences before the worker encounters an underlying surface such as a floor or the ground. Use of such safety harness is known as "tying off". But tying the harness to the building limits the workers range of movement. Thus tie-off harnesses are not viewed favorably in the industry.

Another way the workers, can be protected is for the building contractor to erect heavy and expensive safety nets in order to provide leading edge protection against falls. Cost and maintenance of such nets and associated equipment, the expense of erecting and dismantling such nets and associated equipment, and moving and storing such nets and equipment, can be a substantial increment in the per square foot cost of especially the roof insulation system being installed.

With the anticipation of expanded enforcement efforts by OSHA, building erectors have increased incentive to find ways to meet the existing fall protection requirements.

Another acceptable fall protection system is a passive system wherein a fabric, such as a solid sheet, a woven sheet, or a net-like material, is suspended at or below the work area, optionally supported by a grid of crossing support bands, with the system far enough above any underlying supporting surface to catch and support a worker who falls, thereby to act as a passive fall-protection system.

Under Regulations Section 1926.502(c)(4), OSHA has defined a drop test procedure whereby a such passive fall protection system can be tested. According to the test procedure, a 400 pound weight is dropped onto the fall protection system under stated conditions to determine whether a given system meets the required safety standards. For purposes of complying with government regulations, any system used as a fall protection system need only meet the OSHA-mandated standards related to dropping such 400 pound weight. Of course, the real humanitarian objective is to prevent worker injuries if/when a worker falls from an elevated work location. Thus, any fall protection system which is effective to catch and safely hold a falling worker has operational value, even if such system does not meet OSHA standards.

According to one aspect of the prior art, currently in use in the metal building industry, and intended to meet government fall protection standards, a purported fall protection system uses crossing longitudinal and lateral metal bands extending under the eave, under the ridge, and under the intermediate purlins, and a fabric is installed above the bands and under the purlins, extending across the entirety of a respective bay of the building being constructed, thereby providing a suspended fabric intended to catch and support a falling worker in that bay. Insulation is ultimately installed on the top surface of the fabric whereby the fabric ultimately functions as the vapor barrier portion of the building ceiling insulation system in the finished building.

Testing has shown that currently-available such systems meet the government-mandated drop test standard at certain locations in the bay of a metal building under construction, while failing such drop test at other locations. Typically, such systems fail the drop test adjacent an edge of the bay, where any worker accidental fall is most likely to occur.

Thus, the user cannot be assured that a falling worker will be caught and supported at whatever location he/she falls from at the elevated work location. Such failure can result in worker injury, along with the numerous detrimental results of such injury, as well as resulting government citations associated with the resulting injury, and associated monetary fines and/or assessments, civil lawsuits, and the like.

Failures of the drop test are typically associated with breakage of the bands and penetration of the fabric. Even when the fabric successfully catches and holds the dropped bay, there are significant tears in the fabric at the screws which extend through the fabric at those locations closest to the point of impact. Limited fabric tear at the screws, and breakage of the bands, are acceptable so long as the bag does not pass through the fabric. Both band breakage and limited fabric tears are common even in instances when the "system" passes the test.

The problem plaguing the industry is to design a fall protection system which passes the test irrespective of where, in the bay, is the point of impact of the dropped bag. Testing has shown that the areas of the bay where a passive such fall protection system is most susceptible to failing the drop test are the areas adjacent the rafters.

Accordingly, there is a need for a novel passive fall protection system for use during construction of metal buildings which effectively catches and supports a falling worker working at an elevated height, and which system meets all governmental safety standards at all areas of the bay, including adjacent the rafters.

There is also a need to provide a portion of a building insulation system which functions to provide effective fall protection during construction of the building, while meeting the existing governmental fall protection requirements.

There is further a need for methods of mounting fall protection systems to building structural members during construction of metal buildings, fall protection systems which effectively catch and support a falling worker working at an elevated height, and which systems meet all governmental safety standards.

There is yet further a need to provide novel band and fabric products to passive fall protection systems, which enhance worker safety and efficiency.

Still further, there is a need to provide novel methods of making and using components of the fall protection system so as to enhance worker safety and efficiency.

These and other needs are alleviated, or at least attenuated, or partially or completely satisfied, by novel products, systems, and methods of the invention.

SUMMARY OF THE INVENTION

This invention provides fall protection systems comprising a suspension fabric, supported by a grid-work of longitudinal and lateral bands, in metal building construction. The fall protection system uses safety clips to attach relatively softer lateral bands to intermediate purlins such that the respective lateral bands are directly attached to less than all, or none, of the intermediate purlins, whereby the relatively longer lengths of the lateral bands, at critical locations in the fall protection system, being free from longitudinal expansion restrictions, enables the system to distribute the force/shock of a load dropping onto the system over relatively longer lengths of the respective lateral bands, optionally distributing such force to the eave and ridge as well as to the intermediate purlins, thus reducing the magnitude of a remainder portion of the shock/force of the fallen load which must be absorbed by the fabric. A safety band is added to the typical lateral banding system, within 12 inches to 23 inches of each side of each rafter. A slip clip can be used to prevent transverse tearing of a lateral band upon impact of a load falling on the fall protection system. The invention also provides novel methods of making the suspension fabric, as well as novel methods of distributing the suspension fabric over a bay of the building.

In a first family of embodiments, the invention comprehends a fall protection system in a building roof structure, such building roof structure including structural roof elements which include at least first and second rafters, a space between the first and second rafters defining a first distance between the first and second rafters, each rafter having a length, a top, and opposing first and second ends, the roof structure further comprising an eave, having a length, and extending between the first ends of the first and second rafters, a ridge, having a length, and extending between the second ends of the first and second rafters, and a second distance between the eave and the ridge, the eave and the ridge being disposed on, extending transverse to, and being connected to, the tops of the first and second rafters, and a plurality of intermediate purlins extending between the first and second rafters and spaced from each other between the eave and the ridge, the intermediate purlins being disposed on, and extending transverse to, the tops of the first and second rafters, the fall protection system comprising a first set of longitudinal support bands extending from the first rafter to the second rafter and being connected to the building structural roof elements, the first set of longitudinal support bands being spaced along the lengths of the first and second rafters; a second set of lateral support bands extending from the eave toward the ridge and under the intermediate purlins, the lateral bands of the second set of support bands having first and second end portions which are spaced along the lengths of the eave and the ridge; and a suspension fabric overlying, and being supported by, the first and second sets of support bands, and being attached to the building structural roof elements, a first band of the second set of lateral support bands, next adjacent the first rafter, comprising a safety band and being spaced from the first rafter by a distance of 12 inches to 23 inches, and having at least one of (i) a yield strength of 45 ksi to 85 ksi, or (ii) a tensile strength of 60 ksi to 90 ksi, or (iii) an elongation of 12 percent to 40 percent, the safety band extending from the ridge to the eave under each of the said intermediate purlins, and being attached, for restraint of longitudinal movement of the safety band, at less than all of the said intermediate purlins.

In some embodiments, the safety band is attached, for restraint of longitudinal movement of the safety band, only at opposing first and second ends of the safety band.

In some embodiments, a safety clip is attached to each of the intermediate purlins, the safety clip, at a given purlin, either alone or in combination with the intermediate purlin, defining an opening through the safety clip at or adjacent the given intermediate purlin, the safety band extending through the opening, wherein sides of the opening confine the safety band in the opening against substantial transverse movement of the safety band while accommodating generally unrestricted longitudinal movement of the safety band through the opening.

In some embodiments, the safety band extends through a slip clip at the eave, and is secured to the eave through the slip clip, the slip clip having a length and a width, and comprising a main leg having opposing sides, and return legs extending across the width of the slip clip from the opposing sides and overlying, and being spaced from the main leg, the first band being confined against transverse movement of the first band between the main leg and the return legs.

In some embodiments, the safety band has (i) a yield strength of 45 ksi to 85 ksi, optionally 45 ksi to 75 ksi, optionally 51 ksi to 64 ksi, optionally an average yield strength of about 58 ksi, or (ii) a tensile strength of 60 ksi to 90 ksi, optionally 65 ksi to 85 ksi, optionally 65 ksi to 78 ksi, optionally an average tensile strength of about 72 ksi, or (iii) an elongation of 12 percent to 40 percent, optionally 22 percent to 37 percent optionally an average elongation of about 31 percent, or (iv) Rockwell B hardness of 64 to 79, optionally Rockwell hardness of about 72.

In some embodiments, the safety band is spaced from the first rafter by a distance of 14 inches to 18 inches, optionally 15 inches to 17 inches, optionally about 16 inches.

In some embodiments, the invention comprehends a fall protection system in a building roof structure, such building roof structure including structural roof elements which include at least first and second rafters, a space between the first and second rafters defining a first distance between the first and second rafters, each rafter having a length, a top, and opposing first and second ends, the roof structure further comprising an eave, having a length, and extending between the first ends of the first and second rafters, a ridge, having a length, and extending between the second ends of the first and second rafters, and a second distance between the eave and the ridge, the eave and the ridge being disposed on, extending transverse to, and being connected to, the tops of the first and second rafters, and a plurality of intermediate purlins extending between the first and second rafters and spaced from each other between the eave and the ridge, the intermediate purlins being disposed on, and extending transverse to, the tops of the first and second rafters, the fall protection system comprising a first set of longitudinal support bands extending from the first rafter to the second rafter and being connected to the building structural roof elements, the first set of longitudinal support bands being spaced along the lengths of the first and second rafters; a second set of lateral support bands extending from the eave toward the ridge and under the intermediate purlins, the lateral bands of the second set of support bands having first and second end portions which are spaced along the lengths of the eave and the ridge; and a suspension fabric overlying, and being supported by, the first and second sets of support bands, and being attached to the building structural roof elements, a first band of the second set of lateral support bands having at least one of (i) a yield strength of 45 ksi to 85 ksi, or (ii) a tensile strength of 60 ksi to 90 ksi, or (iii) an elongation of 12 percent to 40 percent, the first band extending from the ridge to the eave under each of the intermediate purlins, and being attached, for restraint of longitudinal movement of the first band, only at opposing first and second ends of the first band, the first band extending through a slip clip at the eave, and being secured to the eave through the slip clip, the slip clip having a length and a width, and comprising a main leg having opposing sides, and return legs extending across the width of the slip clip from the opposing sides and overlying, and being spaced from the main leg, the first band being confined against transverse movement of the first band between the main leg and the return legs.

In some embodiments, a safety clip is attached to each of the intermediate purlins, the safety clip, at a given purlin, either alone or in combination with the intermediate purlin, defining an opening through the safety clip at or adjacent the given intermediate purlin, the first band extending through the opening, wherein sides of the opening confine the first band in the opening against substantial transverse movement of the first band while accommodating generally unrestricted longitudinal movement of the first band through the opening.

In some embodiments, the first band has (i) a yield strength of 45 ksi to 85 ksi, optionally 45 ksi to 75 ksi, optionally an average yield strength of about 58 ksi, and (i) a tensile strength of 60 ksi to 90 ksi, optionally 65 to 85 ksi, and optionally an average tensile strength of about 72 ksi, and (iii) an elongation of 12 percent to 40 percent, optionally 22 percent to 37 percent, optionally an average elongation of about 31 percent, and (iv) Rockwell B hardness of 64 to 79, optionally an average Rockwell B hardness of about 72.

In some embodiments the first band being spaced from the first rafter by a distance of 14 inches to 18 inches.

In some embodiments, each of the lateral bands extends from the ridge to the eave under each of the intermediate purlins, and is attached, for restraint of longitudinal movement of the respective lateral bands, only at opposing first and second ends of the respective bands, each lateral band extending through a slip clip at the eave, and being secured to the eave through the respective slip clip.

In a third family of embodiments, the invention comprehends a fall protection system kit for use in a building roof structure, the fall protection system kit comprising a supply of coiled banding, the banding being no more than 2 inches wide and no more than 0.05 inch thick, and at least some of the banding having (i) a yield strength of 45 ksi to 85 ksi, and (ii) a tensile strength of 60 ksi to 90 ksi, and (iii) an elongation of 12 percent to 40 percent;

one or more rolls of suspension fabric, each roll of suspension fabric comprising multiple layers of such fabric wound about a central axis; and a supply of safety clips, each safety clip having one of (a) upper and lower legs, extending from a common bight connecting the upper and lower legs to each other, the upper and lower legs being spaced from each other, a distance between the upper and lower legs, across the space, being at least as great as the thickness of the banding, a first aperture extending through the upper leg and a second aperture extending through the lower leg, the first and second apertures being generally aligned with each other and so spaced from the bight that, when a screw is driven through both of the apertures and into a receiving structure, thereby closing the space between the upper and lower legs at the apertures and defining a flange at the apertures, a passage remains open through the safety clip, the passage being bounded by inner surfaces of the upper and lower legs, the bight, and the flange, the passage accommodating longitudinal movement of the banding through the passage while confining the banding against substantial transverse movement of the banding, and (b) a main leg having opposing, upwardly-extending first and second end portions thereof terminating at a common elevation, and first and second end flanges extending from the end portions at the common elevation, first and second apertures extending through the first and second end flanges such that, when the safety clip is mounted to an element of the roof structure element by mechanical fasteners extending through the apertures and into such roof structure element, with the main leg spaced from the element of the roof structure, a passage is defined in part by the safety clip and in part by the respective roof structure element, the passage extending between the safety clip and the respective roof structure element, the passage being of such dimensions that the banding can be extended longitudinally through the passage while being confined, while in the passage, against substantial transverse movement relative to the passage.

In some embodiments, the one or more rolls of suspension fabric are substantially devoid of surface air between the layers of fabric.

In some embodiments, the one or more rolls of suspension fabric are wound on a core and are substantially devoid of surface air between the layers of fabric.

In some embodiments, in a given roll of the suspension fabric, a protective plastic layer extends between adjacent layers of the suspension fabric in an outer portion of the roll, the protective plastic layer extending from between the adjacent layers of the suspension fabric and being wound about an outer surface of the suspension fabric.

In some embodiments, at least some of the banding is about 1 inch wide and about 0.020 inch to about 0.025 inch thick.

In some embodiments, the banding is configured and adapted to, be used as lateral bands, extending from eave to ridge and under intermediate purlins, in a fall protection system, the kit further comprising a set of instructions specifying that respective ones of the lateral bands are to be anchored against longitudinal movement only at opposing ends of the bands, the set of instructions optionally instructions specifying that a lateral band next adjacent a rafter be spaced from 12 inches to 23 inches from the respective rafter, the set of instructions optionally specifying that at least one lateral band be mounted to each intermediate purlin using a safety clip, the set of instructions optionally specifying either that (i) the core of suspension fabric be temporarily anchored to the roof structure, and a free end of the roll of suspension fabric be extended across a bay of the building roof structure, or (ii) a free end of the roll of suspension fabric be temporarily anchored to the roof structure, and the roll of suspension fabric, on the care, be extended across the bay of the building roof structure.

In a fourth family of embodiments, the invention comprehends, in a roof structure of a building, such roof structure including structural roof elements which include at least first and second rafters, each rafter having a length, a top, and opposing first and second ends, the roof structure further comprising an eave, having a length, and extending between the first ends of the first and second rafters, a ridge, having a length, and extending between the second ends of the first and second rafters, and a plurality of intermediate purlins extending between the first and second rafters and spaced from each other between the eave and the ridge, the eave, the ridge, and the intermediate purlins being disposed on, and extending transverse to, the tops of the first and second rafters, a method of enhancing a prospect of passing a drop test wherein a 400 pound load is dropped from 50.5 inches above a suspension fabric of a fall protection system such that an edge of the load impacts the suspension fabric within 6 inches of a building rafter, the method comprising specifying a first set of longitudinal support bands extending from the first rafter to the second rafter and being connected to the building structural roof elements, the first set of longitudinal support bands being spaced along the lengths of the first and second rafters; a second set of lateral support bands extending from the eave toward the ridge and under the intermediate purlins, the lateral bands of the second set of support bands having first and second end portions which are spaced along the lengths of the eave and the ridge; and a suspension fabric overlying, and being supported by, the first and second sets of support bands, and being attached to the building structural roof elements, a first band of the second set of lateral support bands, next adjacent the first rafter, comprising a safety band and being spaced from the first rafter by a distance of 12 inches to 23 inches, and having at least one of (i) a yield strength of 45 ksi to 85 ksi, or (ii) a tensile strength of 60 ksi to 90 ksi, or (iii) an elongation of 12 percent to 40 percent, the safety band extending from the ridge to the eave under each of the intermediate purlins, and being attached, for restraint of longitudinal movement of the safety band, only at opposing first and second ends of the safety band.

In some embodiments the method further comprises specifying that a safety clip be attached to each of the intermediate purlins, the safety clip, at a given purlin, either alone or in combination with the intermediate purlin, defining an opening through the safety clip at or adjacent the given intermediate purlin the safety band extending through the opening, wherein sides of the opening confine the safety band in the opening against substantial transverse movement of the safety band while accommodating generally unrestricted longitudinal movement of the safety band through the opening.

In some embodiments, the method further comprises specifying that the safety band have (i) a yield strength of 51 ksi to 64 ksi, optionally an average yield strength of about 58 ksi, and (ii) a tensile strength of 65 ksi to 78 ksi, optionally an average tensile strength of about 72 ksi, and (iii) an elongation of 22 percent to 37 percent, optionally an average elongation of about 31 percent, and (iv) Rockwell B hardness of 64 to 79, optionally are average Rockwell B hardness of about 72.

In some embodiments, the method further comprises specifying that the safety band be spaced from the first rafter by a distance of 14 inches to 18 inches, optionally 15 inches to 17 inches.

In a fifth family of embodiments, the invention comprehends, in a roof structure of a building, such roof structure including structural roof elements which include at least first and second rafters, each rafter having a length, a top, and opposing first and second ends, the roof structure further comprising an eave, having a length, and extending between the first ends of the first and second rafters, a ridge, having a length, and extending between the second ends of the first and second rafters, and a plurality of intermediate purlins extending between the first and second rafters and spaced from each other between the eave and the ridge, the eave, the ridge, and the intermediate purlins being disposed on, and extending transverse to, the tops of the first and second rafters, a method of enhancing a prospect of passing a drop test wherein a 400 pound load is dropped from 50.5 inches above a suspension fabric of a fall protection system such that an edge of the load impacts the suspension fabric within 6 inches of a building rafter, the method comprising installing, in such building, a fall protection system, comprising a first set of longitudinal support bands extending from the first rafter to the second rafter and being connected to the building structural roof elements, the first set of longitudinal support bands being spaced along the lengths of the first and second rafters; a second set of lateral support bands extending from the eave toward the ridge and under the intermediate purlins, the lateral bands of the second set of support bands having first and second end portions which are spaced along the lengths of the eave and the ridge; and a suspension fabric overlying, and being supported by, the first and second sets of support bands, and being attached to the building structural roof elements, a first band of the second set of lateral support bands, next adjacent the first rafter, comprising a safety band and being spaced from the first rafter by a distance of 12 inches to 23 inches, and having at least one of (i) a yield strength of 45 ksi to 85 ksi, or (ii) a tensile strength of 60 ksi to 90 ksi, or (iii) an elongation of 12 percent to 40 percent, the safety band extending from the ridge to the eave under each of the intermediate purlins, and being attached, for restraint of longitudinal movement of the safety band, only at opposing first and second ends of the safety band.

In some embodiments, the method further comprises attaching a safety clip to each of the intermediate purlins, the safety clip, at a given purlin, either alone or in combination with the intermediate purlin, defining an opening through the safety clip at or adjacent the given intermediate purlin, the safety band extending through the opening, wherein sides of the opening confine the safety band in the opening against substantial transverse movement of the safety band while accommodating generally unrestricted longitudinal movement of the safety band through the opening.

In some embodiments, the method further comprises selecting a such safety band having (i) a yield strength of 51 ksi to 64 ksi, optionally an average yield strength of about 58 ksi, and (ii) a tensile strength of 65 ksi to 78 ksi, optionally an average tensile strength of bout 72 ksi, and (iii) an elongation of 22 percent to 37 percent, optionally n average elongation of about 31 percent, and (iv) Rockwell B hardness of 64 to 79, optionally an average Rockwell B hardness of about 72.

In some embodiments, the method further comprises spacing the safety band from the first rafter by a distance of 14 inches to 18 inches, optionally 15 inches to 17 inches.

In a sixth family of embodiments, the invention comprehends, in a roof structure of a building, such roof structure including structural roof elements which include at least first and second rafters, each rafter having a length, a top, and opposing first and second ends, the roof structure further comprising an eave, having a length, and extending between the first ends of the first and second rafters, a ridge, having a length, and extending between the second ends of the first and second rafters, and a plurality of intermediate purlins extending between the first and second rafters and spaced from each other between the eave and the ridge, the eave, the ridge, and the intermediate purlins being disposed on, and extending transverse to, the tops of the first and second rafters, and a fall protection system comprising a first set of longitudinal support bands extending from the first rafter to the second rafter and being connected to the building structural roof elements, the first set of longitudinal support bands being spaced along the lengths of the first and second rafters; a second set of lateral support bands extending from the eave toward the ridge and under the intermediate purlins, the lateral bands of the second set of support bands having first and second end portions which are spaced along the lengths of the eave and the ridge; and a suspension fabric overlying, and being supported by, the first and second sets of support bands, and being attached to the building structural roof elements, a method of controlling against transverse tear in a such support band, the method comprising mounting the respective support band to an element of the roof structure with the support band extending through a slip dip, the slip clip having a length and a width, and comprising a main leg having opposing sides, and return legs extending across the width of the slip dip from the opposing sides and overlying, and being spaced from the main leg, the respective support band being confined against transverse movement of the support band between the main leg and the return legs.

In a seventh family of embodiments, the invention comprehends, in a roof structure of a building, such roof structure including structural roof elements which include at least first and second rafters, each rafter having a length, a top, and opposing first and second ends, the roof structure further comprising an eave, having a length, and extending between the first ends of the first and second rafters, a ridge, having a length, and extending between the second ends of the first and second rafters, and a plurality of intermediate purlins extending between the first and second rafters and spaced from each other between the eave and the ridge, the eave, the ridge, and the intermediate purlins being disposed on, and extending transverse to, the tops of the first and second rafters, a method of protecting construction workers against accidental injury resulting from falls from elevation, the method comprising installing a fall protection system comprising a first set of longitudinal support bands extending from the first rafter to the second rafter and being connected to the building structural roof elements, the first set of longitudinal support bands being spaced along the lengths of the first and second rafters, a second set of lateral support bands extending from the eave toward the ridge and under the intermediate purlins, the lateral bands of the second net of support bands having first and second end portions which are spaced along the lengths of the eave and the ridge, and a suspension fabric overlying, and being supported by, the first and second sets of support bands, and being attached to the building structural roof elements, a first band of the second set of lateral support bands, next adjacent the first rafter, comprising a safety band and being spaced from the first rafter by a distance of 12 inches to 23 inches, and having at least one of (i) a yield strength of 45 ksi to 85 ksi, or (ii) a tensile strength of 60 ksi to 90 ksi, or (iii) an elongation of 12 percent to 40 percent, the safety band extending from the ridge to the eave under each of the intermediate purlins, and being attached, for restraint of longitudinal movement of the safety band, only at opposing first and second ends of the safety band, a safety clip being attached to each of the intermediate purlins, the safety clip, at a given purlin, either alone or in combination with the intermediate purlin, defining an opening through the safety clip at or adjacent the given the intermediate purlin, the safety band extending through the opening, wherein sides of the opening confine the safety band in the opening against substantial transverse movement of the safety band while accommodating generally unrestricted longitudinal movement of the safety band through the opening.

In some embodiments, the safety band is spaced from the first rafter by a distance of 14 inches to 18 inches, optionally 15 inches to 17 inches.

In some embodiments, the method comprises selecting a safety band having (i) a yield strength of 51 ksi to 64 ksi, optionally an average yield strength of about 58 ksi, and (ii) a tensile strength of 65 ksi to 78 ksi, optionally an average tensile strength of about 72 ksi, and (iii) an elongation of 22 percent to 37 percent, optionally an average elongation of about 31 percent, and (iv) Rockwell B hardness of 64 to 79, optionally an average Rockwell B hardness of about 72.

BRIEF DESCRIPTION OF THE DRAWINGS

Illustrative embodiments of the invention are described hereinafter, by way of examples only, with reference to the accompanying drawings.

Figure 1:
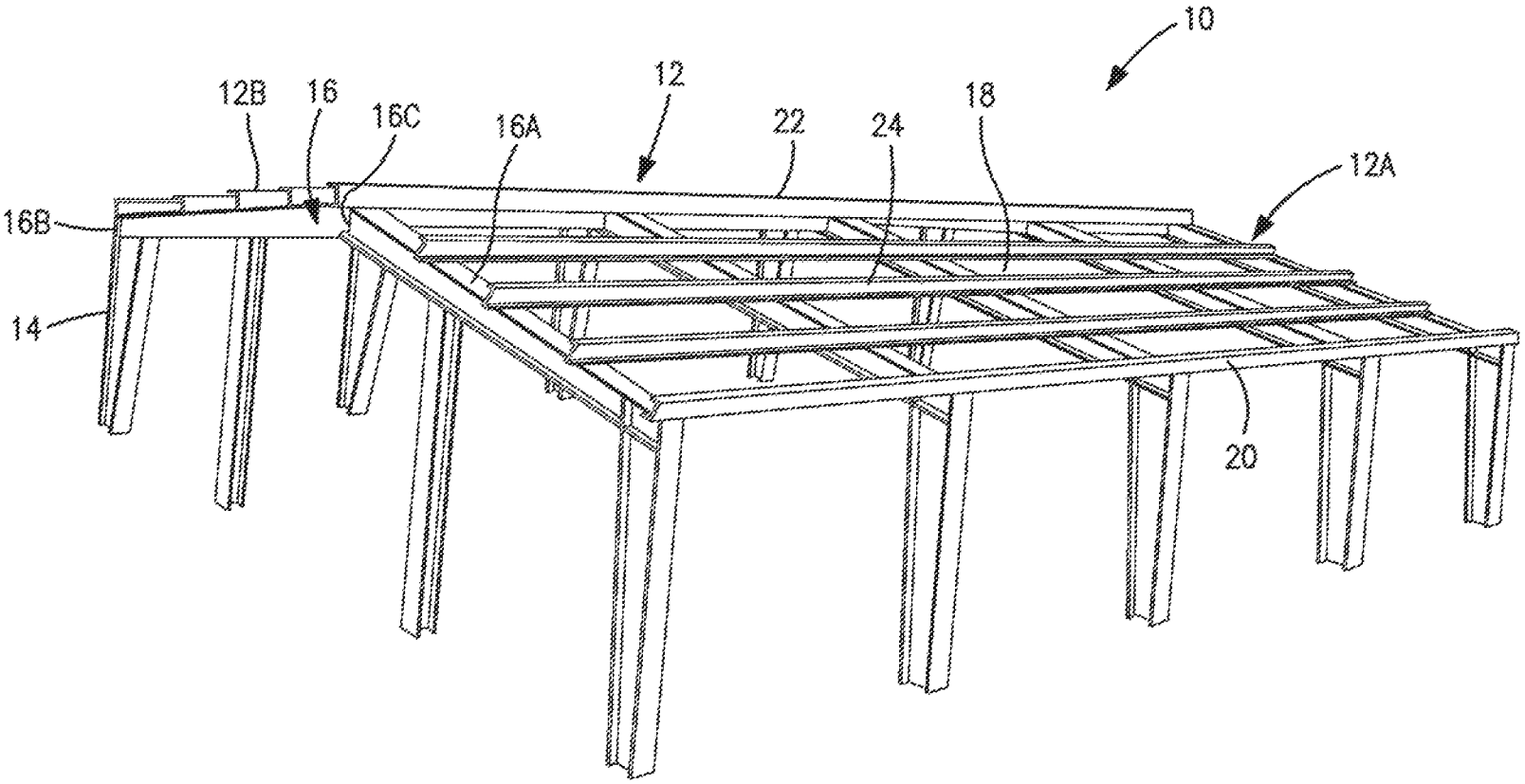
FIG. 1 PRIOR ART
FIG. 1 shows a perspective view, from above the eaves, of a typical metal building structure, including columns, rafters, eaves, ridges, and intermediate purlins.

The invention is not limited in its application to the details of construction, or to the arrangement of the components, or to the methods of construction, set forth in the following description or illustrated in the drawings. The invention is capable of other embodiments or of being practiced or carried out in various other ways. Also, it is to be understood that the terminology and phraseology employed herein is for purpose of description and illustration and should not be regarded as limiting. Like reference numerals are used to indicate like components.

DETAILED DESCRIPTION OF THE ILLUSTRATED EMBODIMENTS

FIG. 1 illustrates the primary structural members of a typical metal building 10 having first and second roof slopes 12A and 12B. Vertical support for the structural elements of the roof, designated generally as 12, is provided by upstanding columns 14 positioned along side walls and end walls of the building. Rafters 16 overlie the tops of the columns and are supported by the columns. Rafters 16 span the width of the building, creating a series of open spaces between rafters 16, the open spaces being commonly referred to as "bays" 18 in the construction industry, the bays representing distances between respective ones of the rafters. Each rafter has an upper surface 16A, and opposing first 16B and second 16C ends.

Figure 2:
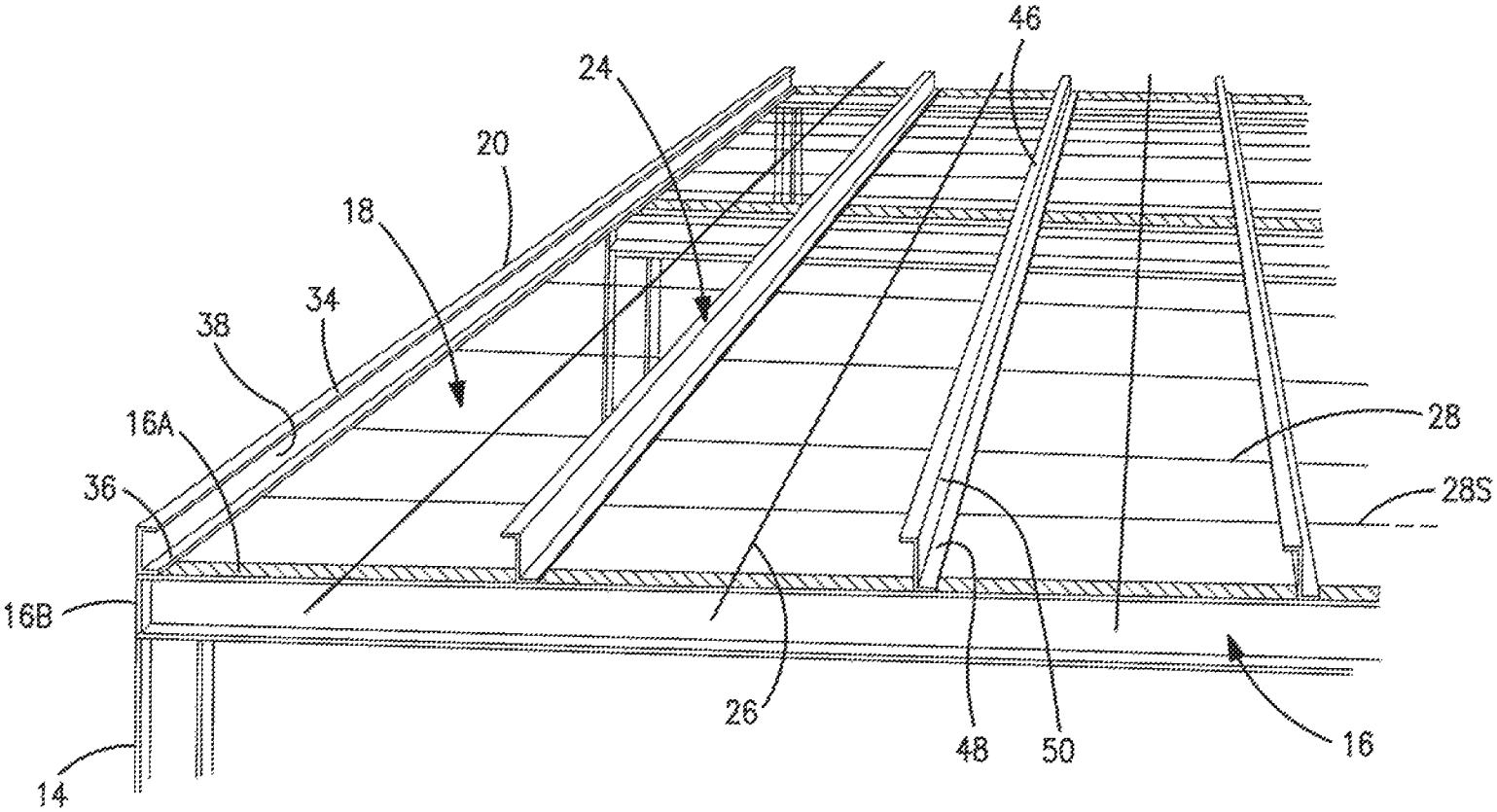
FIG. 2 is a perspective view, from above the roof, of part of a bay of a metal building, showing columns, rafters, purlins, an eave, and a grid-work of crossing bands.
Figure 4:
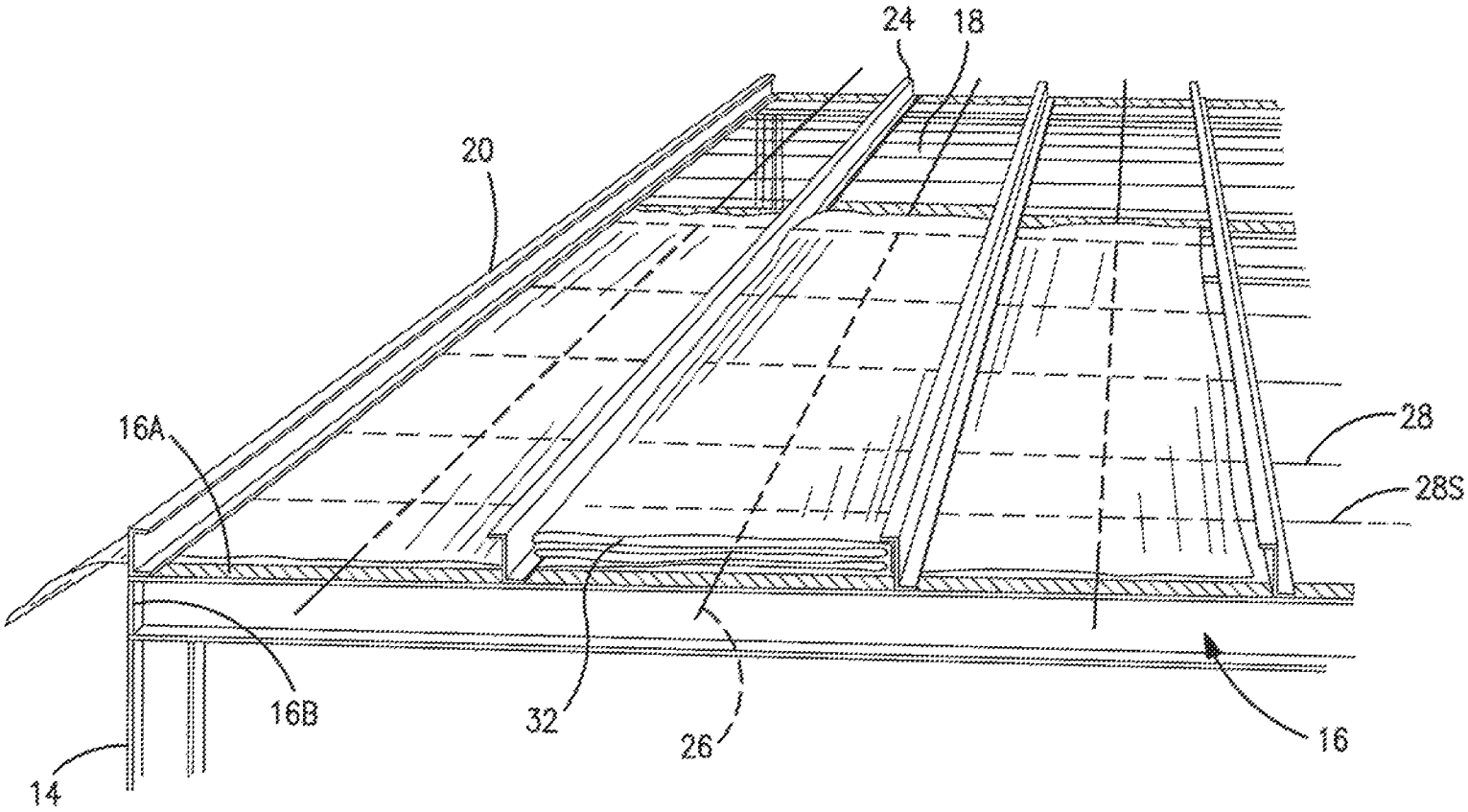
FIG. 4 is a perspective view as in FIG. 2 showing the suspension fabric fully extended across the width of the bay and partially extended lengthwise over the band grid-work and under the eave and under one of the purlins, in a single bay.

According to the embodiments illustrated in FIGS. 1, 2, and 4, eaves 20, expressing generally "C"-shaped cross-sections, are positioned at the down-slope ends of the rafters 16, and lengths of the eaves extend along the length of the building, above the outer wall of the building, and provide lateral support to the skeletal structure of the building between respective ones of the columns 14, at the outer building wall. A given eave extends between the first ends 16B of respective ones of the rafters.

Figure 5:
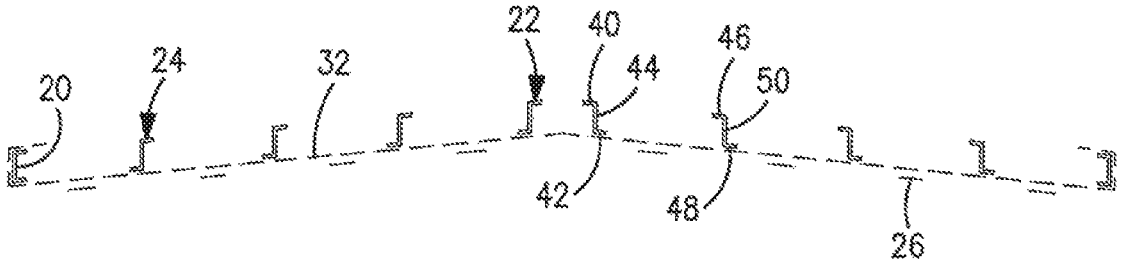
FIG. 5 is a diagrammatic end view of a roof structure of a metal building, showing longitudinal band spacing with respect to the eaves, the ridge, and the intermediate purlins.

Ridge members 22, expressing "Z"-shaped cross-sections as illustrated in FIG. 5, have lengths which overlie, and are attached to, the upper surfaces of rafters 16. The ridge members are positioned at the up-slope ends of the rafters, and run the length of the building parallel to the eaves, typically above the central portion of the building. The ridge members provide lateral support to the skeletal structure of the building between respective ones of rafters 16, typically at an internal portion of the building, away from the building side walls in the illustrated embodiments. A given ridge member extends between the second ends 16C of the respective ones of the rafters. Where the roof has a single pitch direction, the ridge can be positioned proximate one of the outer walls of the building.

The ridge members and the eave members overlie, extend transverse to, and are attached to, the upper surfaces of the respective rafters 16, and are spaced from each other by distances which generally correspond to the lengths of the respective rafters.

Intermediate purlins 24 express "Z"-shaped cross-sections. The intermediate purlins overlie, extend transverse to, and are attached to, upper surfaces 16A of the respective rafters. Purlins 24 are spaced from each other along the lengths of the rafters. The purlins extend parallel to each other and parallel to any ridges and eaves and, overall, span the length of the bay, whereby the purlins are displaced from each other and from any ridges and eaves along the spaces between the respective eave and the ridge.

As shown in FIG. 2, the fall protection support system, namely the suspension system, of this invention includes a supporting grid-work formed by crossing elongate steel bands, including longitudinal support bands 26 and lateral support bands 28. Support bands 26, 28 of the grid-work are supported by various ones of the building structural members, as described herein, and the collective grid-work generally defines an imaginary plane, extending into the sheet of the drawing illustrated FIG. 5. Such imaginary plane extends parallel to a set of imaginary straight lines, spaced from each other and extending between the lower surfaces of the eaves 20, the ridge 22, and intermediate purlins 24, and further extending parallel to imaginary straight lines which connect the upper surfaces of the rafters.

Figure 3:
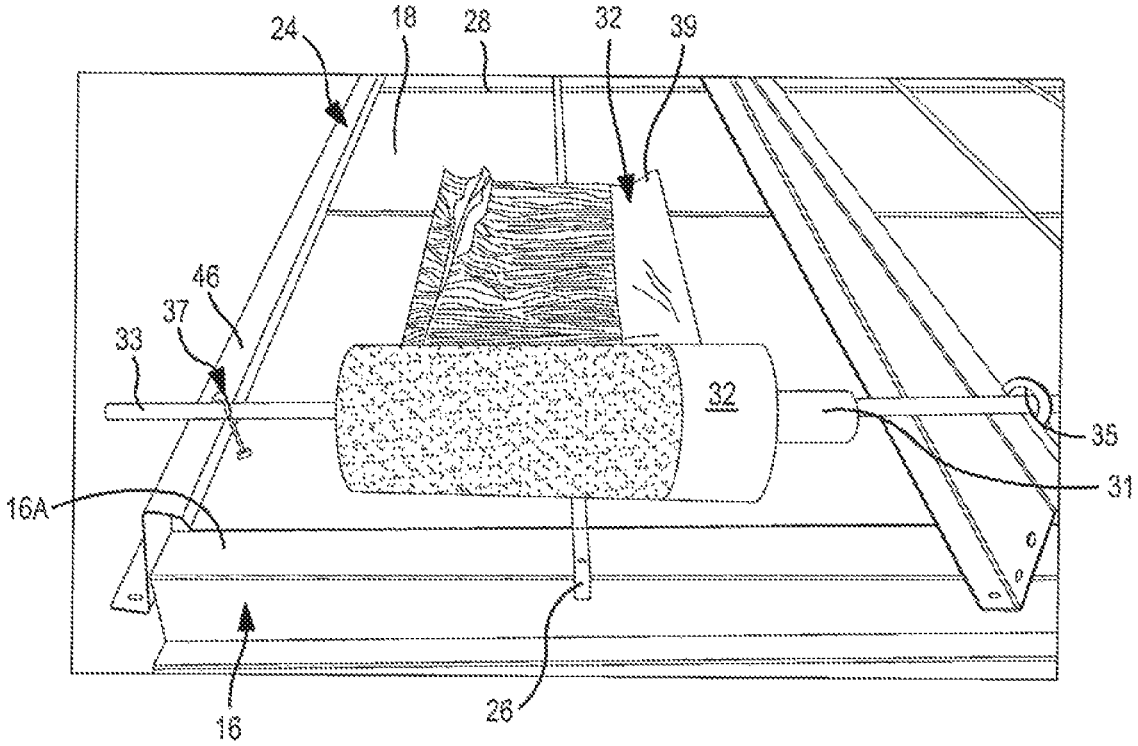
FIG. 3 is a perspective view from above the elevation of two purlins and a rafter, looking along a run of space from a first rafter toward a second rafter, showing a roll of suspension fabric mounted to the purlins, a leading edge of one side of the fabric having been drawn part-way across the width of the bay.

Support bands 26, 28 support a high strength fabric 32, the fabric being shown partially extended across a bay in FIG. 3, and fully extended across the bay and partially unfolded in FIG. 4 and, in FIG. 5, the fabric is suggested by the dashed line under the eave, under the ridge, and under the intermediate purlins, and above longitudinal bands 26, bands 26 being shown in FIG. 5 in end view. Fabric 32 in the illustrated embodiments also serves as a vapor barrier for the insulation system which is ultimately installed at the roof of the building.

Starting with the structural skeleton of the building as illustrated in FIG. 1, a fall protection system of the invention is installed generally as follows. Longitudinal metal bands 26 are extended from the upper surface of a first one of the rafters to the upper surface of a second one of the rafters at angles which are typically, but not necessarily, perpendicular to the respective rafters. The number of longitudinal bands 26 depends to some degree on the distance between the respective ones of the intermediate purlins 24. In the invention, typically only a single longitudinal band 26 is used between each pair of next-adjacent purlins 24. However, in certain systems, which can be engineered based on the technology disclosed herein, two or more longitudinal bands may be used where such additional band use may be cost-effective and/or when use of such additional band may be needed in order to satisfy an applicable governmental standard. Of course, the greater the number of bands used, the greater the cost of the band system. Accordingly, the user is motivated to have the system engineered so as to use as few of such longitudinal bands as possible while meeting the required safety standards.

A length of a given longitudinal band 26 extends across a given bay and is extended across the upper surface of each rafter overlain by the respective band, and is attached to the upper surfaces, or other surfaces, of the respective rafters. Where the longitudinal band 26 extends across multiple bays, the longitudinal band is secured, for restrained longitudinal movement, to the upper surfaces of those rafters which are most remote from one another. Optionally, but not necessarily, the longitudinal band may be secured to one or more of any intermediate rafters.

Longitudinal bands 26 are fastened to those rafters, rake channels, or rake angle(s) (not shown) which correspond with the end portions of the bands, by conventional attachment means such as by self-drilling screws. Longitudinal bands 26 are pulled tight between the rafters so as to, in part, and at this stage of installation, begin to define the aforementioned band grid, and the imaginary plane of support provided by the band grid, immediately under the intermediate purlins. Band attachment tools, known in the art, may be used in attaching the bands, either temporarily or permanently, to the rafters or rake channels, thus to instill a suitable, conventionally known, level of tension in bands 26 as the bands are being installed.

Each eave has a top flange 34, a bottom flange 36, and an upstanding web 38 extending between the top and bottom flanges, and connecting the top flange to the bottom flange. The top and bottom flanges are arranged such that the profile of the eave defines a "C"-shaped structure, perhaps best seen in FIG. 6.

While the eave profiles shown define generally perpendicular turns between the flanges 34 and 36, and upstanding web 38, actual eave profiles typically define a modest acute angle (not shown) between the bottom flange and the upstanding web and a corresponding modest obtuse angle (not shown) between the top flange and the upstanding web. Such acute and obtuse angles adapt the eave to the specific slope of the roof for which the eaves are designed, while providing that the upstanding web conform to the vertical orientation of the respective side wall of the building.

Correspondingly, each ridge has a top flange 40, a bottom flange 42, and an upstanding web 44 extending between the top and bottom flanges, and connecting the top flange to the bottom flange. The top and bottom flanges are arranged such that the profile of the ridge defines a "Z"-shaped structure, illustrated in FIG. 5.

Similarly, each intermediate purlin has a top flange 46, a bottom flange 48, and an upstanding web 50 extending between the top and bottom flanges, and connecting the top flange to the bottom flange. The top and bottom flanges are arranged such that the profile of the respective purlin defines a "Z"-shaped structure, illustrated in FIGS. 5 and 9.

Lateral bands 28 are typically installed after the longitudinal bands 26 are in place. Lateral bands 28 extend transverse to, typically perpendicular to, the longitudinal bands. Lateral bands 28 generally underlie and support longitudinal bands 26. Lateral bands 28 may be first attached to the respective ridge 22. Bands 28 may be attached to any suitable surface of the ridge which enables the band to pass, from the location of attachment, under and in tensioned contact with, the bottom flange of the ridge. For example, a lateral band can be attached to the bottom surface of the bottom flange of the ridge, with intervening fabric 32, and extend from there toward the eave.

As an alternative, one end of a given lateral band can extend up alongside, and be fastened to, the surface of the upstanding ridge web which faces away from the eave on the respective slope of the roof. The band passes alongside, and turns about, the edge of the bottom flange of the ridge which faces away from the respective eave, and then passes under, and in general contact with, the bottom surface of the bottom flange, again with intervening fabric, and extends from there toward the eave.

As a still further example of attachment of a lateral band to the ridge, the band can be attached to the top surface of the top flange, turn about the upper edge of the top flange which is more remote from the respective eave, extend from there down toward the bottom ridge flange, turn about the edge of the bottom flange and pass alongside, and in general contact with, the bottom surface of the bottom flange, and extend from there toward the eave, again with the fabric between the band and the ridge.

The lateral bands are extended, from the bottom surface of the bottom flange of the ridge toward the respective eave, passing under the longitudinal bands, and pulled tight to minimize sag in both the lateral bands and the respective overlying longitudinal bands. The so-tightened lateral bands are in general contact, again with intervening fabric, with the bottom surface of the bottom flange of the respective eave. With the so-tightened lateral bands in contact with the bottom surface of the bottom flange of the respective eave, the lateral bands are fastened to the eave so as to maintain the tension in the lateral bands, thus to lift the lateral bands toward the bottom flanges of the overlying intermediate purlins.

The number of lateral bands 28 to be used between a respective pair of next-adjacent rafters, and the spacing between the lateral bands, varies with the distance between the rafters. Typically, the lateral bands are 36 inches to 40 inches apart, optionally up to 48 inches apart in some cases and up to 60 inches in some cases.

Traditional banding stock used for bands 26 and 28 is a hot-dip zinc/aluminum alloy-coated Grade 80 structural steel, 0.023 inch thick, having longitudinal tensile yield strength of at least 93 ksi, such Grade 80 banding sometimes being referred to in the industry as "full hard". Such steel banding is typically about 1 inch wide and continuous length. Such traditional "full hard" steel banding is available from Steelscape, A BlueScope Steel Company, Kalama, Wash. as ZINCALUME® Steel Grade 80 (Class 1).

Representative properties of such Grade 80 (Class 1) banding, 0.023 inch thick, from Steelscape are as follows:

Yield strength—58.1 ksi average, 51.3-64.0 ksi range

Tensile strength—102.2 ksi average, 95.4-105.3 ksi range

Elongation in 2 inch sample—10% average, 9.6-10.3% range

Hardness, Rockwell B Scale—93.4 average, 92-95 range

"Ksi" means "thousands of pounds per square inch".

It is known that, when a fall protection system of the prior art, using 0.023 inch Grade 80 banding, 1 inch wide, is tested using the government-mandated test procedure, even if the system successfully passes the test, namely catches and holds the falling object, the suspension fabric tears at the locations of the screws, closest to the location of impact, which fasten the fabric and bands to the purlins. Typically, the longitudinal banding, and sometimes the lateral banding, closest to the falling object, also breaks.

As a corrective measure, some commercially available alleged fall protection systems require the use of two Tek screws, at least two inches apart, through the lateral banding and into the bottom flange of each respective eave. The purpose of the second screw is believed to be an attempt to provide additional strength to the attachment of the band to the eave, to prevent the band from tearing past the screws, or tearing the screw diagonally out the side of the band, when an object impacts the fall protection system fabric.

The determination of passing or failing the government-defined drop test is whether the falling object proceeds through the fabric, known as a test failure, or is successfully held and supported by the fabric, which is a successful, passing of the test.

The inventors herein have discovered, by their experience, by their testing, that existing commercially available alleged fall protection systems, even those using the two-screw attachment, fail the government-defined drop test when the force is applied adjacent a rafter, or anywhere the impact is passed directly to fewer than 4 bands surrounding the point of impact. Accordingly, the invention contemplates inventive novel lateral banding.

Known prior-art-alleged fall protection systems specify that each lateral band be attached by a Tek screw to the bottom flange of each intermediate purlin, whereby a substantial fraction of the force of a worker falling, or the force of a drop test, is transferred through the respective nearby lateral bands to the next adjacent purlins.

Where the force of a drop/impact/fall is applied at the lateral band which is next-adjacent a rafter, all, or substantially all, of that force may be transferred by a single one of such lateral bands to the building structural roof members.

In the invention, these lateral bands which are the closest ones of the lateral bands to the opposing sides of the rafters are referred to as safety bands 28S, in part because the safety bands are the bands which are the most likely ones of the lateral bands to receive the stress of having a worker fall, e.g. from a rafter, onto the suspension fabric used in the fall protection system. Further, the inventors have discovered that the safety bands, when stressed by a fall, absorb more of the force than when any other lateral band is stressed by a fall.

The inventors contemplate that the force of a fall/drop test away from the rafters can be dispersed among at least four bands which surround the drop location; whereas by contrast, when such force is imposed close to the rafter, only 3 bands are disposed around the drop site, namely one lateral band and two longitudinal bands, whereby those 3 bands, in that instance, do the work done by 4 bands at locations further away from the rafter.

The safety bands 28S are graphically delineated in FIGS. 2 and 4 by dashed extensions of such bands on the right side of the drawing.

Figure 6:
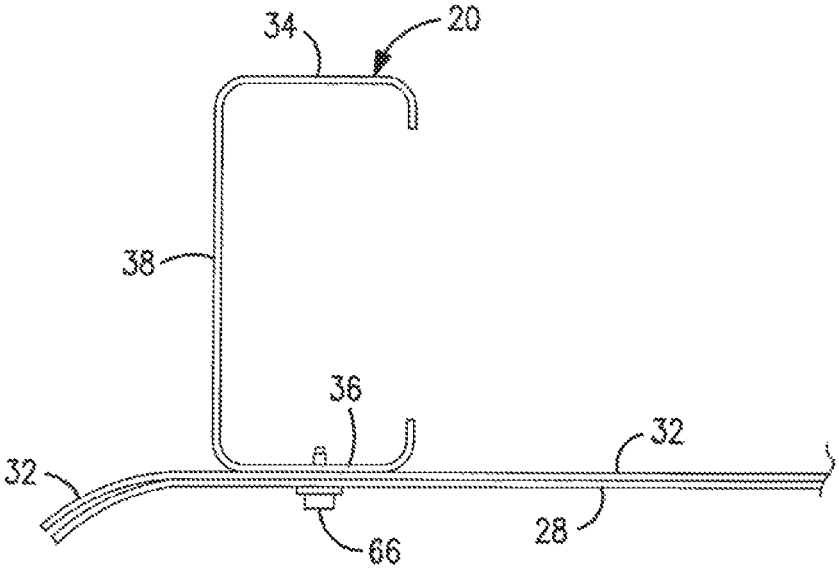
FIG. 6 is an edge view showing a lateral band fastened, attached to the bottom flange of the eave.

FIG. 6 shows the attachment of a lateral band to an eave 20. FIGS. 10A, 10B, 11, 11A, and 12-15 show an inventive approach to supporting the lateral bands, and thus the band grid system, from intermediate purlins 24.

Figure 10A:
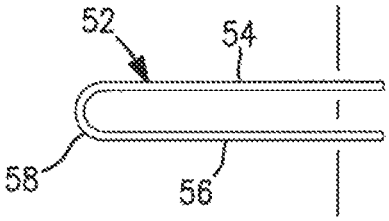
FIG. 10A shows an end view of the safety clip designed and configured to be mounted to the bottom flange of an intermediate purlin.
Figure 10B:
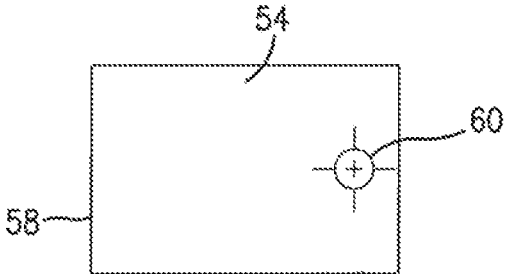
FIG. 10B shows a bottom view of a safety clip of FIG. 10A.

FIGS. 10A and 10B illustrate a safety clip 52 for use in supporting ones of the lateral bands from ones of the intermediate purlins. As illustrated in FIGS. 10A and 10B, safety clip 52 has an upper leg 54, a lower leg 56, and a bight 58 joining the upper and lower legs. Apertures 60 in upper and lower legs 54, 56, are aligned with each other, thus providing a passage which can receive a screw for fastening the safety clip to the lower flange of an overlying purlin.

Figure 11:
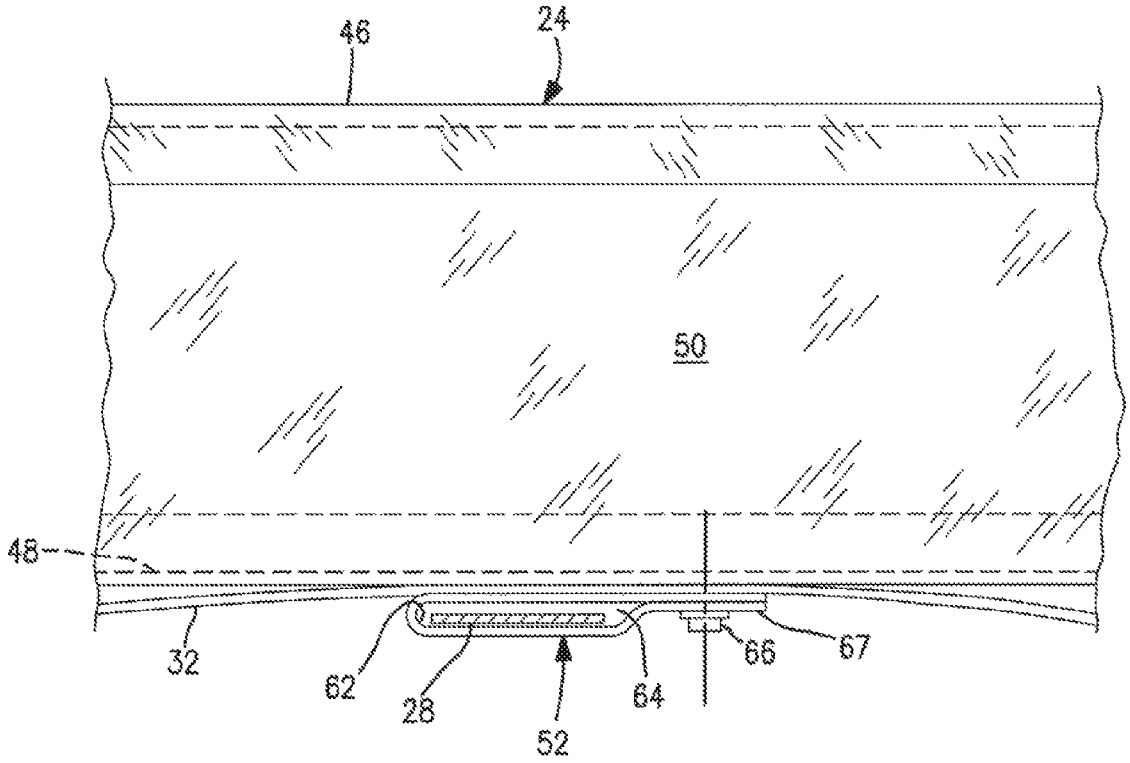
FIG. 11 shows an end view of a safety clip as in FIGS. 10A and 10B mounted to the bottom surface of the bottom flange of an intermediate purlin, through an intermediate washer, using a single Tek screw as in FIG. 9, and a safety band passing through the opening in the safety clip, and being confined against free lateral/transverse movement beyond the confines of the loop of the safety clip.
Figure 12:
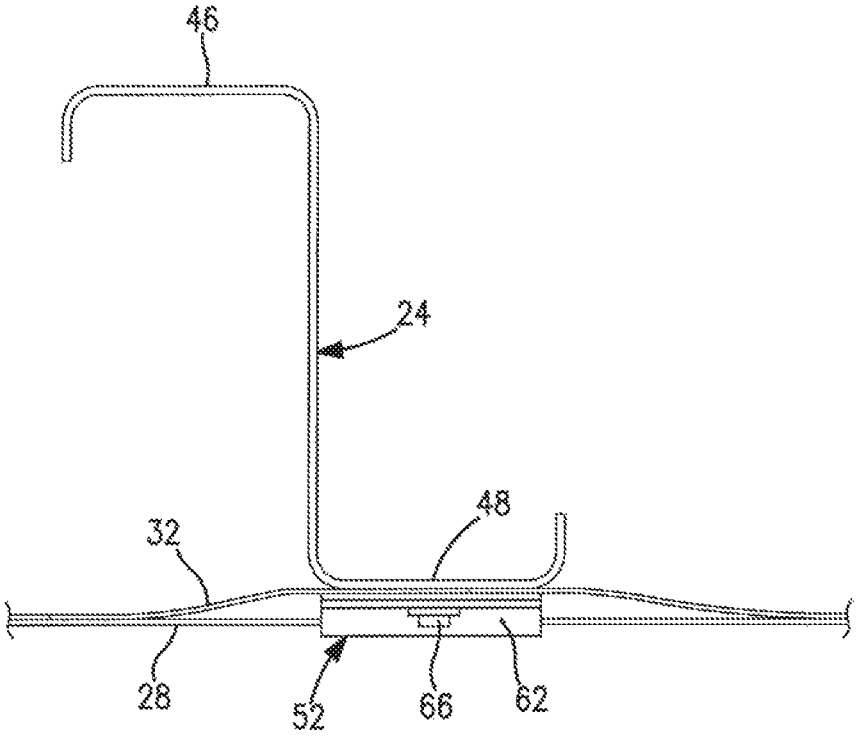
FIG. 12 shows the safety clip of FIG. 11 mounted to the bottom surface of the bottom flange of the intermediate purlin as in FIG. 11, but from an angle parallel to the bottom flange of the purlin and perpendicular to the length of the purlin.

FIG. 11 shows an end view of a safety clip 52 fastened to the bottom surface of a bottom flange 48 of one of the intermediate purlins 24. FIG. 12 shows the safety clip so fastened to the bottom surface of the bottom flange of the purlin from an end view/profile view, of the purlin. Still referring to FIGS. 11 and 12, a Tek screw 66 extends through the apertures 60 in the safety clip and thence into the bottom flange of the purlin, trapping the suspension fabric between the safety dip and the bottom flange of the purlin, making secure the attachment to the purlin. As seen in FIG. 11, when screw 66 is driven into attachment of the safety clip to the purlin, the force applied in tightening the screw closes the space between the ends of the upper and lower legs 54, 56, thus creating a flange 67 adjacent openings 60, as well as defining a closed loop 62, surrounding an opening 64 which extends through the safety clip.

The safety clip is oriented relative to the ridge and eave such that opposing ends of opening 64 are disposed, respectively, toward the corresponding ridge 22 and eave 20. Accordingly, the passage which extends through opening 64 extends in the same direction as lateral bands 28.

FIG. 11 shows one of the lateral bands 28 extending through opening 64. As illustrated in FIG. 11, safety clip 52 supports the lateral band in close proximity to the bottom of the respective purlin. The walls of loop 62, which define the opening and thus surround band 28, limit the lateral movement of band 28 relative to loop 62, such that the walls of the loop keep that portion of the band, which is facing the walls, confined to the space defined by the loop. Thus, the band cannot move laterally outside the confines of the walls of the loop.

However, safety clip 52 places no limitations on the ability of lateral band 28 to move longitudinally with respect to the safety clip. Thus, other than incidental friction between the walls of the loop, such as at the bottom surface of the lateral band and the top surface of the lower leg of the safety clip, longitudinal movement of the lateral band relative to the safety clip is generally unhindered, unimpeded.

Figure 11A:
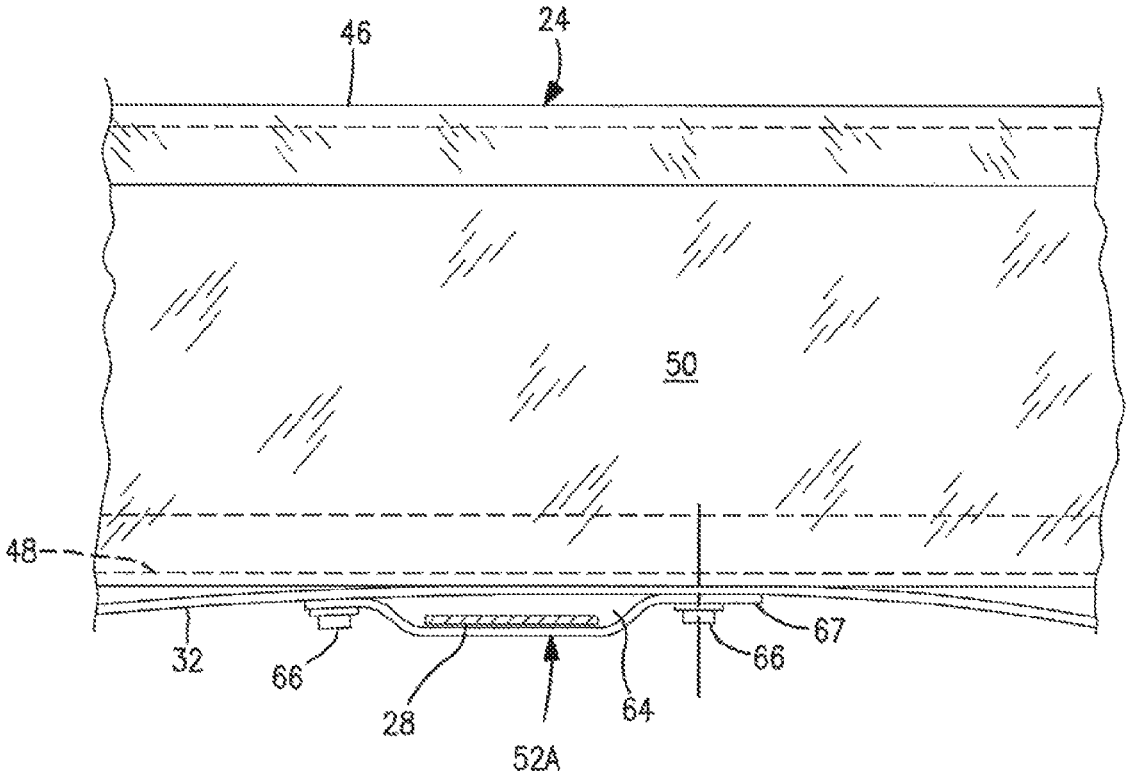
FIG. 11A shows an end view as in FIG. 11, illustrating an alternate safety clip design mounted to an intermediate purlin using first and second screws.

FIG. 11A illustrates an alternate embodiment of the safety clip, enumerated as 52A. Safety clip 52A is made of the same material as safety clip 52, typically the same steel banding that is used for the lateral bands. But rather than folding the clip material on itself as in the embodiments of FIGS. 10A, 10B, 11, and 12, in the embodiment illustrated in FIG. 11A, the material of safety clip 52A is formed in the shape of a flanged shallow "U". Thus, safety clip 52A, as installed, has a centrally-recessed element flanked on both sides by flanges extending from the upper ends of the recessed element. Each flange has an aperture 60, receiving a Tek screw 66 through an intervening washer 68, the screw extending through the washer, through the flange, through suspension fabric 32, and into and through the lower flange of the intermediate pudlin. With the safety dip 52A thus anchored at flanges 67 on both ends of the safety clip, opening 64, and the corresponding passage, is defined in part by the safety clip and in part by the lower flange of the purlin.

Safety clip 52A operates very similar to safety clip 52 in that the installation of safety clip 52A limits lateral movement of band 28 while providing generally unrestricted, unimpeded longitudinal movement of the lateral band relative to the safety dip.

So, rather than building a fall protection system to transfer the impact force on the lateral band to the closest purlins by screwing the lateral band to the bottom flange of each purlin as in the prior art, the invention uses a longer length of banding, defined through the loop of at least one safety dip, on at least some of the lateral bands, to absorb some of the laterally-expressed energy of the impact force as well as, in some bands, to transfer a substantial portion of the laterally-expressed impact force to the ridge and eave of the roof, and/or to one or more of the intermediate purlins which are displaced from the point of impact by at least one purlin.

Figure 13:
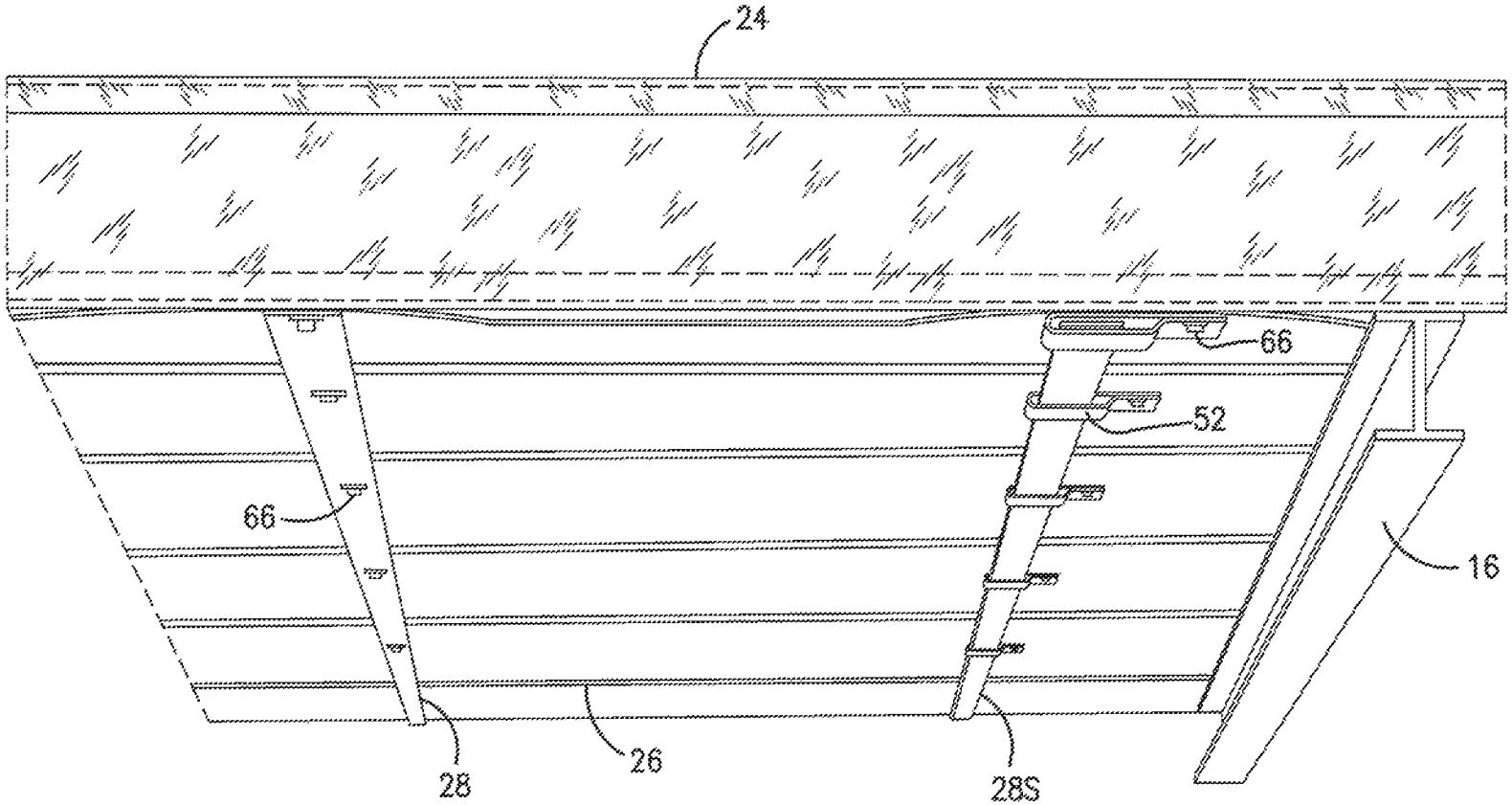
FIG. 13 shows a portion of a bay of a suspension system area which includes the safety clip viewed as in FIG. 11, and first and second next-adjacent lateral bands extending from eave to ridge, the first band being secured against longitudinal movement only at ridge and eave, and passing through safety dips, the second band being secured against longitudinal movement at every purlin.

FIG. 13 illustrates a typical embodiment of fall protection systems of the invention wherein a safety band 28S is next adjacent a rafter 16. In that embodiment, the safety band extends from ridge to eave and is secured by Tek screws 66 to the ridge and the eave. Between the ridge and the eave, the safety band passes through a safety clip 52 at each intermediate purlin between the ridge and the eave.

Figure 13A:
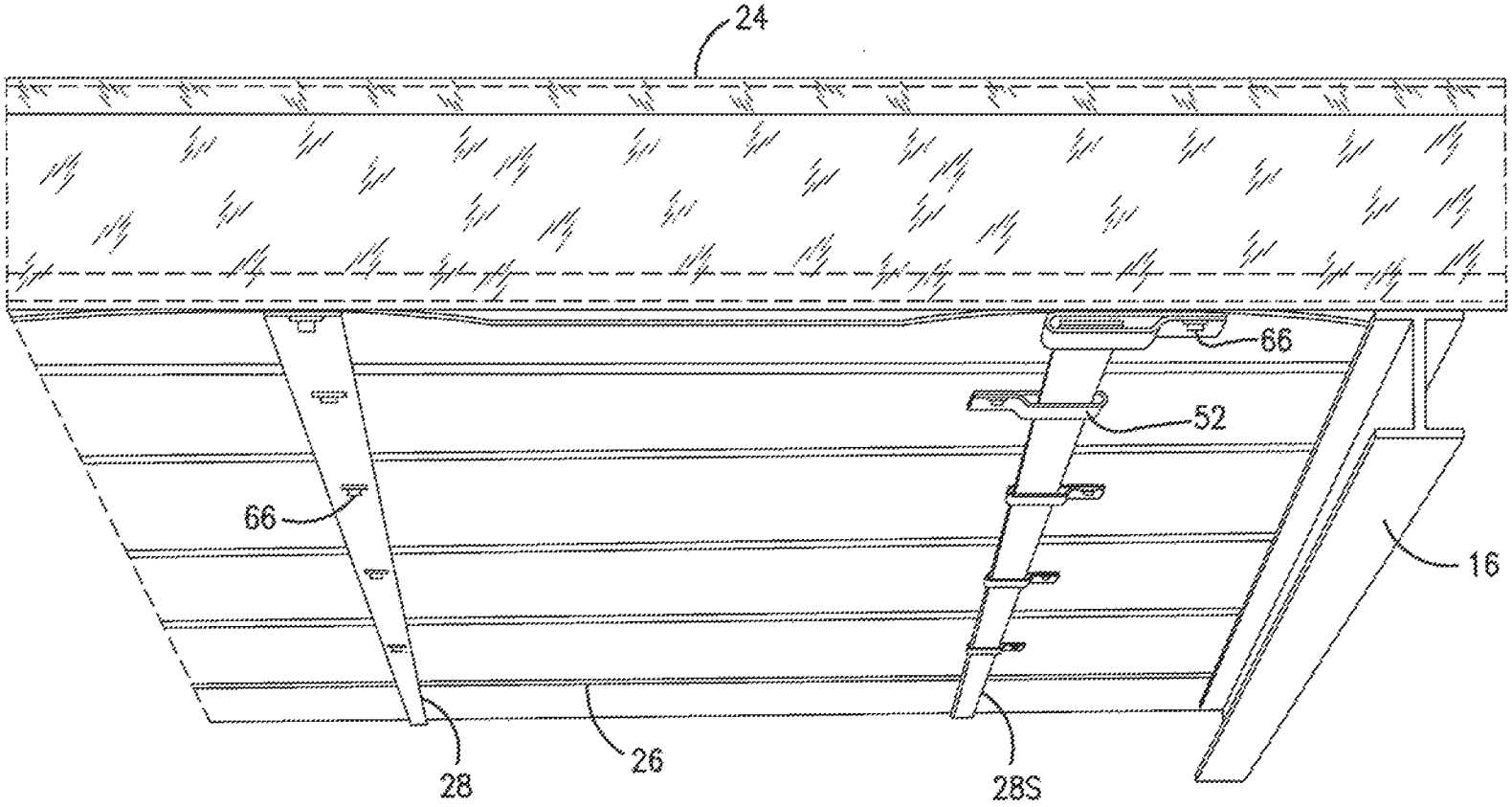
FIG. 13A shows a portion of a bay as in FIG. 13, with the safety clips mounted on alternating sides of the band.

As illustrated, FIG. 13 shows all of the safety clips 52 mounted to the lower flanges of the overlying purlins by screws 66 where all of the screws 66, and all of the respective flanges 67, are on the same side of the band. In another embodiment, some of the screws 66 and flanges 67 are on the opposing side of the band. FIG. 13A shows the screws 66 and flanges 67 on alternating sides of band 28S, as the band extends to successive ones of the purlins.

Thus, the safety band is secured against longitudinal movement of the band only at the ridge and at the eave. Between the ridge and the eave, the safety band is free to move longitudinally through each of the safety dips, while being restricted against lateral movement beyond the boundaries of openings 64 at the respective purlins/safety bands.

FIG. 13 also illustrates that longitudinal bands 26 are typically supported by lateral bands 28, in that the lateral bands underlie the longitudinal bands. Referring again to FIGS. 2 and 4, it is seen again that the longitudinal bands are secured against longitudinal movement only at rafters 16.

A distinctive feature of this invention is that the banding stock used for at least safety bands 28S is softer and more yielding than banding stock which is traditionally used for bands 26 and 28, though the physical dimensions of such bands remain generally the same, at about 1 inch width, 0.023 inch thickness. Thus, banding stock, at 1 inch width, used for safety bands 28S has

- Yield strength, average—45-85 ksi, optionally 45-75 ksi, optionally 50-65 ksi, optionally 55-60 ksi
- Tensile strength, average—60-90 ksi, optionally 65-85 ksi, optionally 65-79 ksi, optionally 70-75 ksi
- Elongation in 2 inch sample—12%-40%, optionally 22%-37%
- Hardness, Rockwell B Scale—50-80, optionally 60-79, optionally 70-75.

"Ksi" means "thousands of pounds per square inch".

Banding material illustrated for use as the safety bands in this invention is available as a hot-dip zinc/aluminum alloy—coated Grade 50 structural steel, from Steelscape, A BlueScope Steel Company, Kalama, Wash. as ZINCALUME® Steel Grade 50 (Class 1).

Yield, tensile and elongation properties, whether for Grade 50 banding or Grade 80 banding, are determined using an Instron Tensile Tester according to ASTM A370-12a. Briefly, a two-inches-long section of a dog-bone shaped sample is placed in the jaws of the test machine, and stretched by the machine until the sample breaks. Yield and ultimate tensile are recorded by the testing machine. Elongation is measured manually according to the test procedure after the sample breaks.

Choosing to not be bound by theory, the inventors herein contemplate that the softer steel banding absorbs more of the force, and especially more of the shock effect of the impact of the drop test, by permanent elongation deformation, than the harder Grade 80 steel, while being strong enough to provide the needed support of fabric 32 and to transfer a remainder portion of the kinetic energy of a dropping object to structural roof members of the building. Thus, while the prior art attempts to use the strength of the steel to transfer a portion of the kinetic energy of the impact of the falling load to the roof structural members, in the invention, and at that lateral band which receives the greatest stress when participating in catching a falling load adjacent the rafter, which is that band next-adjacent the rafter, the invention relies, in first part, on the elongation properties of the softer banding material used for the "safety" bands to absorb more of the kinetic energy of the impact. The invention further relies, in second part, on use of the safety clips to expose a longer length of the safety band to the kinetic energy of the impact force, and to transfer such impact force to a greater number of elements of the roof structural members, whereby a greater fraction of the impact force is transferred away from the point of impact so that a lesser fraction of the impact force remains to be dissipated in the suspension fabric at and immediately adjacent the point of impact.

In light of the benefits provided by using the softer banding material for the safety bands 28S, the invention provides novel dissipation of the kinetic energy portion of the force of impact. Accordingly, the novelty of the invention can be extended such that the remaining bands, including the remaining lateral bands 28, and/or the longitudinal bands 26, use the same softer e.g. Grade 50 steel banding.

Thus, in a first set of embodiments of the invention, the softer steel banding material is used in only the lateral bands, namely safety bands 28S, closest to the rafters while a relatively harder e.g. the full hard Grade 80, banding material is used in the remaining lateral bands and in the longitudinal bands. This first option focuses attention on that lateral band which has the greatest likelihood of having to absorb and transfer all, or almost all, of the kinetic energy portion of the force which gets transferred to the purlins adjacent an impact site close to a rafter.

In a second set of embodiments of the invention, the softer steel banding material is used in all of the lateral bands while a relatively harder, e.g. full hard, banding material is used in all of the longitudinal bands. This second option focuses attention on the relatively shorter length distance between attachments of the (non-safety band) lateral bands to the purlins, whereby relatively shorter lengths of lateral band, compared to relatively longer lengths of longitudinal banding, are tasked with absorbing and transferring impact forces to their next adjacent roof structural elements. Namely, the non-safety-band lateral banding transfers impact force to the next adjacent purlins, which are e.g. 5 feet apart. Thus, the lengths of the (non-safety-band) lateral bands which transfer impact force to roof structural members are typically about 5 feet.

By contrast, the longitudinal bands are anchored to the roof structure only at the rafters, which are commonly 25 feet apart. Thus, the lengths of the longitudinal bands which transfer the impact force to roof structural members are typically at least about 25 feet, about 5 times longer than the transfer portions of the lateral bands. Where a longitudinal band spans multiple bays, and where the longitudinal band is not attached for longitudinal restriction at the intermediate rafters, the lengths of the longitudinal bands which transfer the impact force to roof structural members are typically multiples of 25 feet apart, such as 2 times, 3 times, and the like.

In a third set of embodiments of the invention, the relatively softer Grade 50 banding material is used in all of the longitudinal bands and all of the lateral bands. This third set of embodiments takes full advantage of the relatively greater elongation properties of the Grade 50 banding, to permanently elongate, while effectively passing, to the roof structural members, enough of the remainder portion of the kinetic energy portion of the impact force of the falling object that suspension fabric 32 is able to dissipate the remainder of the impact force without catastrophic failure of the fabric.

Banding used in the invention is distinguished from steel bar stock in that steel bar stock is stiff and rigid. By contrast, the banding used in the invention is thin and flexible such that the banding is typically shipped to the user in rolls. When the banding stock is cut to the e.g. specified 1-inch width, and the resulting bands are loosely draped over rafters spaced e.g. 25 feet apart, mid-sections of the bands readily drape downwardly by multiple feet from the elevations of the rafters. Further, such banding is completely incapable of supporting itself or the overlying suspension fabric until substantial tensile force, which can be manually applied using hand tools, is applied to the banding.

While typical banding has been disclosed herein for both the longitudinal bands and the lateral bands, other banding can be made to work, though likely at greater cost. So wider banding may be thinner, and thicker banding may have lesser width. So long as the respective banding is within the recited ranges of physical strength properties, such banding is within the scope of this invention. To that end, and with such limitations regarding physical properties, banding 1.25 inches, 1.5 inches, 1.75 inches, and up to 2 inches in width, and all widths in between at 0.01 inch increments, and separately banding 0.03 inch, 0.04 inch, and up to 0.05 inch thickness, and all thicknesses in between at 0.01 inch increments, is within the scope of the invention.

Certain fabrics are known in the art for use as suspension fabrics in roof insulation systems, and such fabrics may be acceptable in the fall protection systems of the invention, provided that the bands used in the band grid-work of the invention are sufficiently close together. An exemplary fabric, which the inventors have tested and found satisfactory for use with the band grid-work disclosed herein is available as Type 1070 Vapor Retarder fabric from Intertape Polymer Group, Bradenton, Fla. The Type 1070 fabric is a woven HDPE scrim having the following characteristics as specified by the fabric supplier:

Nominal thickness—9 mils (0.23 mm)
Nominal weight—4.3 oz/yd$^2$ (149 g/m$^2$)
Grab Tensile—Warp 136 lb (605 N)/Weft 126 lb (559 N)
Strip Tensile—Warp 100 lb/in (877)/Weft 90 lb/in (799)
Tongue Tear—Warp 50 lb (222N)/Weft 45 lb (200 N)
Mullen Burst—245 psi (1690 kPa)
Moisture vapor transmission of 0.02 perms.

A typical bay 18 is about 25 feet wide, between pairs of next-adjacent rafters. Within a given bay, lateral bands 28 extend parallel to each other, parallel to the respective rafters which define the bay, and are generally spaced apart by about 36 inches to 40 inches, but no more than 48 inches. Thus, a desired spacing between lateral bands 28 is 36-40 inches; but up to 48 inches is accepted where the increase from 40 inches e.g. up to 48 inches can reduce the number of bands.

Known prior-art-alleged fall protection systems specify that each lateral band be attached by a Tek screw to the bottom flange of each intermediate purlin, whereby a substantial fraction of the force of a worker falling, or the force of a drop test, is transferred through the respective lateral bands to the next adjacent purlins. Where the force is applied at the lateral band which is next-adjacent a rafter, that force is transferred by a single such lateral band.

As illustrated in FIGS. 6, 6A, 7, and 8, the invention contemplates at least three ways of attaching a lateral band to an eave 20. As illustrated in FIGS. 10A, 10B, 11, 11A, and 12-15, the invention contemplates a novel approach to supporting the lateral bands, and thus the band grid system, from intermediate purlins 24 and thereby passing the force transferred to such lateral band farther away from the location of the impact of the fall, as far as to the eave and the ridge.

When a falling/dropping impact force arrives at the suspension fabric, the force received by the suspension fabric has a first directional force component based on gravity, and a second velocity/shock/suddenness component based on the kinetic energy of the falling object. The gravity component of the impact may be resisted by, absorbed by, the resilient deflection characteristics of the materials in the fall protection system. However, such resilient deflection characteristics are typically overwhelmed by the kinetic energy in the velocity/shock/suddenness component of the impact, which addresses the rate at which the respective materials can deflect as the force of the impact is applied to the respective building elements.

Where a safety band 28S, mounted to a purlin by a safety clip 52, is one of the closest lateral bands to the point of impact, a first portion of the entirety of that force which is received at the suspension fabric is transferred, as first tensile forces, into the full length of the longitudinally-mobile portion of the respective safety band and is absorbed by tensile elongation of the safety band.

A second portion of that received force is transferred, by the safety band, through the safety clips which are closest to the location of the impact, and thence to the purlins which are closest to the location of the impact.

A third portion of that received force is transferred, by the safety band, to the purlins, the ridge, or the eave which are next adjacent the purlins which are closest to the location of the impact, such that greater than two, typically at least four, longitudinally-extending structural members of the roof participate in dissipating substantial portions of the impact of the fall/drop.

Where safety clips are used at each purlin, a fourth portion of that received force is transferred by the respective lateral band to the eave and ridge.

A fifth portion of that force is transferred, by the suspension fabric, to respective closest ones of the longitudinal bands, which transfer their received tensile forces to the respective next adjacent rafters.

A sixth remainder portion of that force is distributed about the respective affected area of the suspension fabric. While choosing to not be bound by theory, the inventors herein contemplate that the fabric absorbs both a portion of the directional component of the force of the impact and a velocity/shock/suddenness kinetic energy portion of the force of the impact.

Turning again to the responses of the bands, the tensile forces so imposed on the longitudinal bands and the safety band, or other lateral band mounted by safety dips, are distributed along the full lengths of the respective longitudinal bands and the respective safety band, while the tensile forces imposed on the remaining ones of the lateral bands may be transferred directly to the closest ones of the intermediate purlins unless those bands are supported by the use of safety clips. Thus, the elongation properties of both the longitudinal bands and the safety band are utilized along the full lengths of such bands between their points of attachment at the ridge, the eaves, and the rafters, all of which are disposed at the edges of the respective bay.

The benefit of using the full lengths of the safety bands, or other lateral bands, to absorb the impact force of the fall/drop is that more of the force is dissipated by band elongation rather than that force being retained in the fabric or transferred to the next adjacent purlins. In addition, a portion of the force can be transferred, by the safety band, to additional ones of the purlins, and additional portions of the force can be transferred to the eave and to the ridge. Thus, the use of the safety clips to accommodate longitudinal mobility of lateral band results in dissipating more of the force of the impact in an increased number of elements of the roof structure. By increasing the number of elements of the roof structure which participate in dissipating the force of the impact, the amount of the force which must be dissipated by the fabric and by the bands, or by any one member of the fall protection system is reduced. Indeed, by dispersing the impact force to additional members of the roof structure, fall protection systems of the invention effectively expand the definition of the members of the fall protection system as additional members are involved in arresting a fall. Such reduction in the amount of the force which must be dissipated at/within any one band or the suspension fabric provides increased opportunity for the fabric to survive the force of the impact without the falling object passing through the fabric which is, by definition, a failure of the fall protection system.

FIG. 13 further shows, in one configuration of the fall protection system of the invention, that lateral bands 28 which are not safety bands, namely which are not a lateral band next adjacent a rafter, can, and commonly are, attached to each purlin in a conventional manner, namely by screwing a Tek screw 66, with accompanying washer, through a hole in the lateral band, thence through the suspension fabric, and thence through the lower flange of the respective purlin. The suspension fabric is thus trapped between the lower flange of the purlin and the respective washer/screw combination, which holds the suspension fabric tightly against the lower surface of the lower flange of the purlin.

Figure 14:
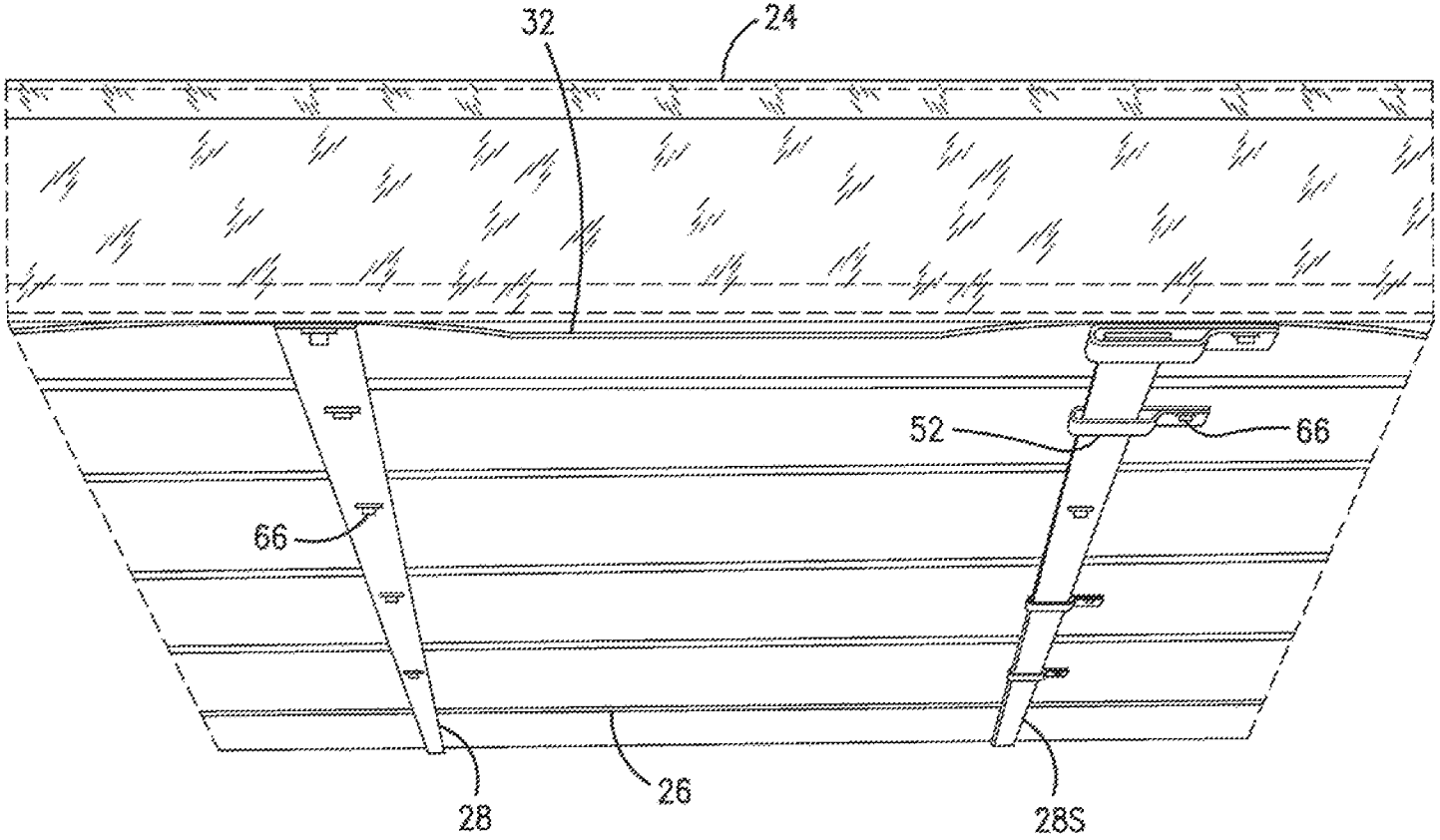
FIG. 14 shows a portion of a suspension system as in FIG. 13 wherein the first band is secured, against longitudinal movement, to one of the intermediate purlins.
Figure 15:
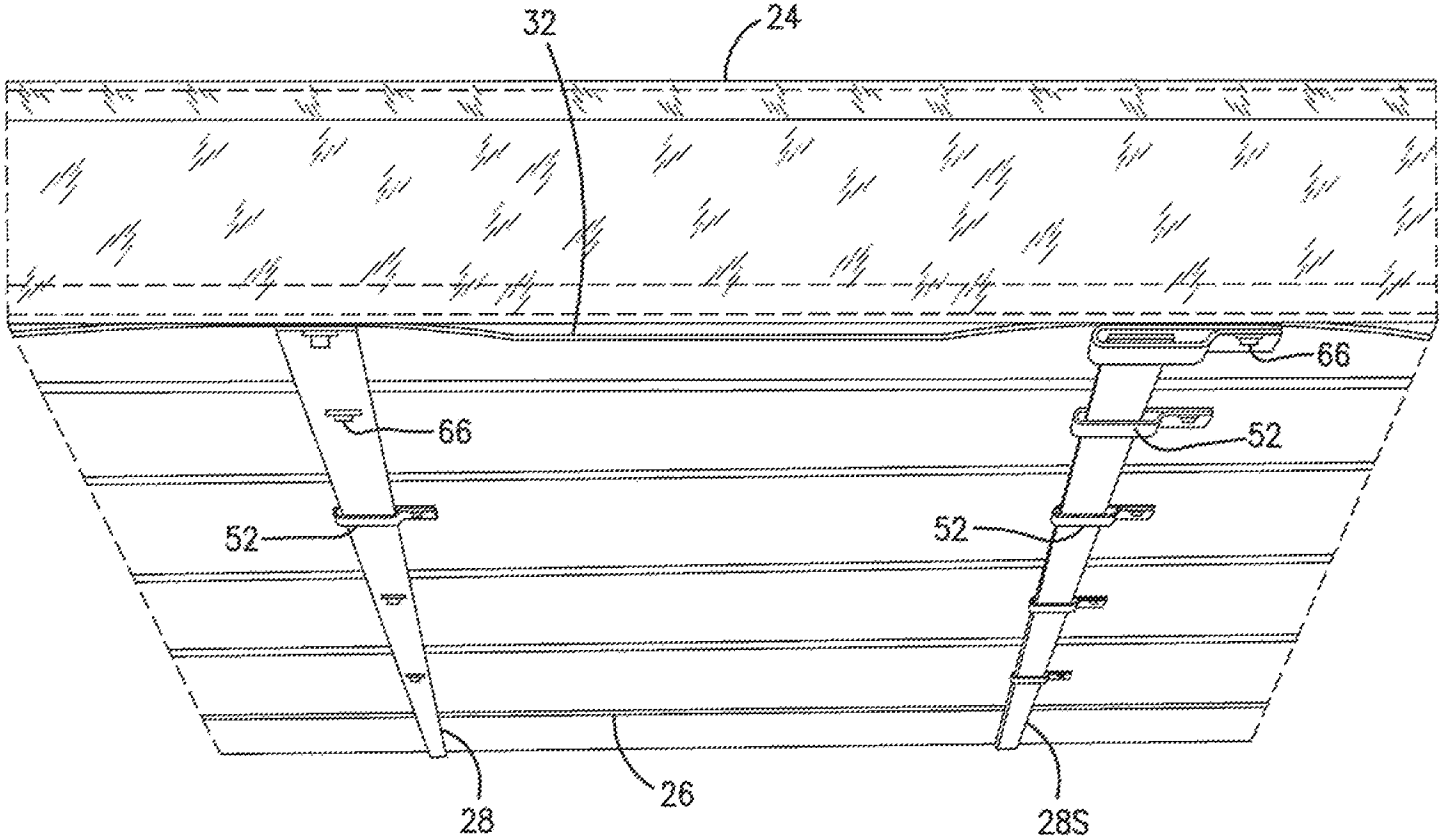
FIG. 15 shows a portion of a suspension system as in FIG. 14 wherein the second band is secured, against longitudinal movement, to fewer than all of the intermediate purlins.

FIG. 14 shows another embodiment of fall protection systems of the invention wherein the e.g. Grade 50 safety band is secured to the intermediate purlins using the safety clip at less than all of the purlins. FIG. 15 illustrates that some of the lateral bands which are not safety bands can be mounted to the bottom flange of a purlin using the safety clip. Thus, the designer of a given system has the flexibility to specify the safety dips for some but not all of the intersections of any one of the lateral bands. But there is both a materials cost and a labor cost attendant to use of the safety clip whereby the system designer assesses trade-offs between band strength and cost, fabric strength and cost, and the all-in, namely materials plus labor, cost of installing respective ones of the safety clips. The typical system, however, is shown in FIG. 13 where the safety bands pass through safety clips at each intermediate purlin and the remaining lateral bands are screwed directly to the purlins, through the fabric, at each intermediate purlin.

Referring again to FIGS. 6, 6A, 7, and 8, the invention contemplates at least three ways of attaching a lateral band, and the suspension fabric, to an eave 20. Starting with FIG. 6, the invention contemplates that a lateral band 28, whether or not a safety band 28S, underlies the suspension fabric 32, and traps the fabric between the lateral band and the bottom flange of the overlying eave. As a first method of attachment, in some embodiments, the lateral band can be attached to eave 20 by one or more, e.g. self-drilling, Tek screws 66 extending through respective one or more holes spaced longitudinally along the length of the respective lateral band, through a cooperating washer 68, and driven thence into and through the bottom flange 36 of the eave. In typical uses, a single Tek screw is sufficient to hold the lateral band to the bottom flange of the eave.

Figure 6A:
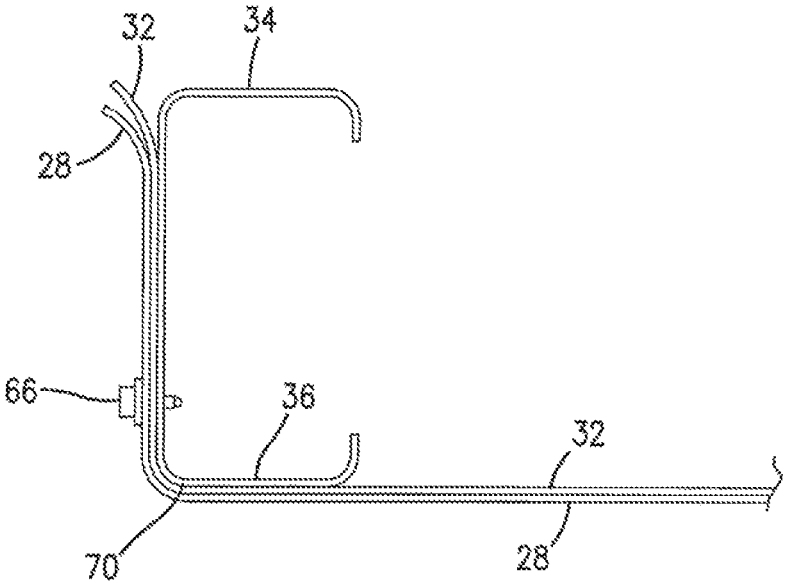
FIG. 6A is an edge view showing a lateral band fastened, attached to the upstanding web of the eave.

In a second set of embodiments, illustrated in FIG. 6A, the lateral band, whether or not a safety band 28S, underlies the suspension fabric 32 and traps the fabric between the respective lateral band and the bottom flange 36 of the overlying eave. In this second set of embodiments, the lateral band extends past the remote edge 70 of the bottom flange of the eave which is remote from the corresponding ridge 22, turns an e.g. 90 degree corner about that remote edge 70 of the bottom flange and extends upwardly from the bottom flange alongside the upstanding web 38 of the eave. One or more Tek screws 66 extend through web 38 of the eave, terminating the band attachment at web 38. In typical uses, a single Tek screw is sufficient to hold the lateral band to the web of the eave. In this embodiment, the friction associated with the band turning the corner at remote edge 70 enables the band to transfer some of the force from a drop impact to the eave through the full width of the band, especially at corner 70, as opposed to the instance as in e.g. FIG. 6 where part of the band has been removed, by making a hole in the band, to receive screw 66, thus removing some of the material of the band at the precise location where the stress in the band is being transferred to the eave.

Figure 7:
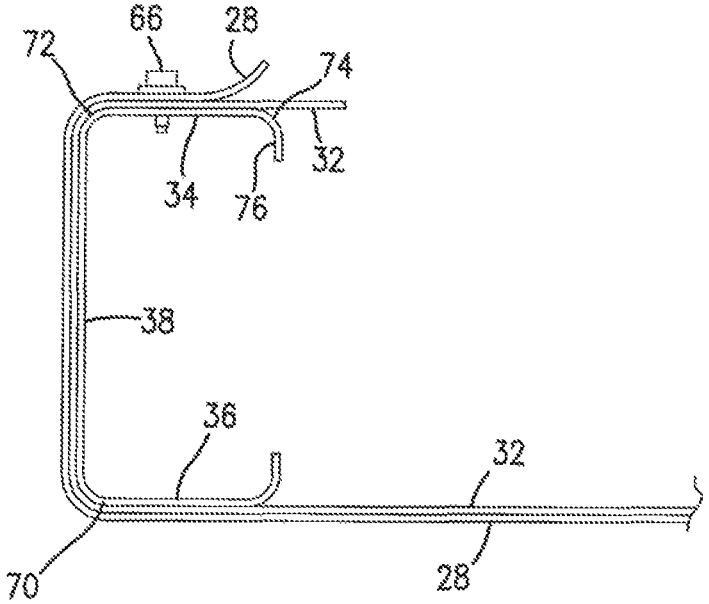
FIG. 7 is an edge view as in FIG. 6 wherein the lateral band turns a first corner about the remote edge of the bottom flange of the eave, extends up the web, turns a second corner about the remote edge of the top flange of the eave, and is fastened, attached to the top flange of the eave.

In a third set of embodiments, illustrated in FIG. 7, the lateral band, whether or not a safety band 28S, underlies the suspension fabric 32 and traps the fabric between the respective lateral band and the bottom surface of bottom flange 36 of the overlying eave. In this third set of embodiments, the lateral band extends past the remote edge 70 of the bottom flange of the eave which is remote from the corresponding ridge 22, turns a first, e.g. 90 degree, corner about the remote edge 70 of the bottom flange and extends upwardly from the bottom flange alongside the upstanding web 38 of the eave to a remote edge 72 of top flange 34 of the eave, and turns a second e.g. 90 degree corner about remote edge 72, thence to extend toward the respective ridge 22. One or more Tek screws 66 extend through top flange 34 of the eave, terminating the band attachment at top flange 34 of the eave. In typical uses, a single Tek screw is sufficient to hold the lateral band to the top flange of the eave. In this embodiment, the friction associated with the band turning the corners at remote edge 70 and remote edge 72 enables the band to transfer some of the force from a drop impact to the eave through the full width of the band, especially at corners 70 and 72, as opposed to the instance as in e.g. FIG. 6 where part of the band has been removed to receive screw 66, thus removing some of the material of the band at the precise location where the stress in the band is being transferred to the eave.

Figure 8:
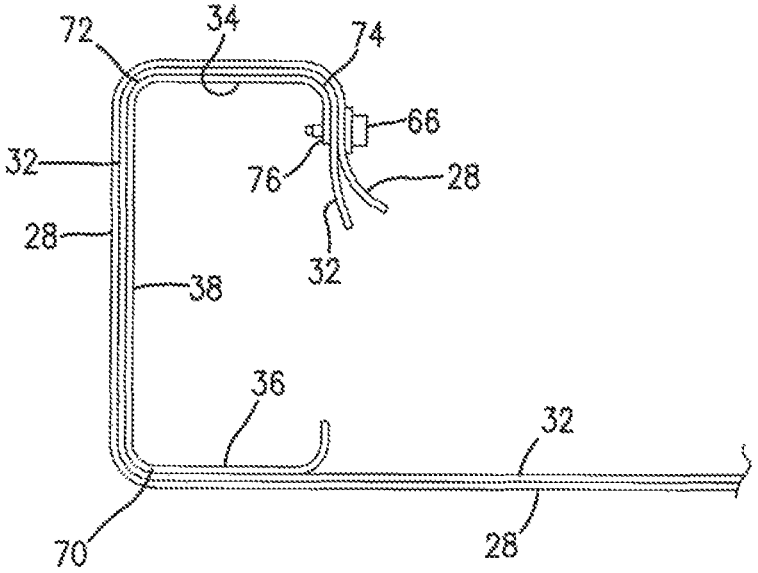
FIG. 8 is an edge view as in FIG. 7 wherein the lateral band turns a third corner about the distal edge of the top flange of the eave and is attached to the top flange return of the eave.

In a fourth set of embodiments, illustrated in FIG. 8, the lateral band, whether or not a safety band 288, underlies the suspension fabric 32 and traps the fabric between the respective lateral band and the bottom flange 36 of the overlying eave. In this third set of embodiments, the lateral band extends past the remote edge 70 of the bottom flange of the eave which is remote from the corresponding ridge 22, turns a first, e.g. 90 degree, corner about that remote edge 70 of the bottom flange and extends upwardly from the bottom flange alongside the upstanding web 38 of the eave to a remote edge 72 of top flange 34 of the eave, turns a second e.g. 90 degree corner about remote edge 72, thence to extend the lateral band toward the respective ridge 22, and turns a third e.g. 90 degree corner about the distal edge 74 of the top flange, and overlies a top flange return 76 of the eave. One or more Tek screws 66 extend through the top flange return 76 of the eave, terminating the band attachment at top flange return 76. In typical uses, a single Tek screw is sufficient to hold the lateral band to the top flange return. In this embodiment, the friction associated with the band turning the corners at remote edge 70, remote edge 72, and proximal edge 74 enables the band to transfer some of the force from a drop impact to the eave through the full width of the band, especially at corners 70, 72, and 74 as opposed to the instance as in e.g. FIG. 6 where part of the band has been removed, by making a hole in the band, to receive screw 66, thus removing some of the material of the band at the precise location where the stress in the band is being transferred to the eave.

The common feature of the attachments in FIGS. 6A, 7 and 8 is that lateral band 28 turns about at least one corner of the eave before being attached by the Tek screw to the eave. Such turning of the one or more corners before the attachment of the band to the eave operates to transfer some of the tensile force from the band to the eave at a location between the one or more screws 66 and the distal edge of the bottom flange of the eave, thereby correspondingly reducing the tensile force on the band at the screw, with corresponding reduction in the interfacial force between the one or more screws 66 and the band. Reduced force between screws and band means reduced prospect for failure of the band at the one or more screws whereas any failure of the band when attached according to FIG. 6 is almost always a failure of the band at screw 66.

In addition, referring now to FIGS. 6A, 7, and 8, turning the band about a corner of the eave before reaching the screw means that the full width of the band can be used to apply the force to the eave. Namely, if the force is applied directly through a screw as in FIG. 6, a fraction of the width of the band, and thus some strength of the nominal strength of the band, is lost in removal of band material at the screw aperture 60. Restated, any force which is transferred to the eave ahead of the screw aperture is transferred by the full width of the band, reducing the likelihood that the band will break at the hole in the process of transferring the force to the eave.

As an alternative to wrapping the fabric about the eave with the lateral band, the fabric can extend inside the eave instead of outside the eave. In such instance, a leading edge of the fabric enters the eave above bottom flange 36, passes across the top of the bottom flange to web 38, passes along the inside surface of web 38 and up to upper flange 34 and thence toward the ridge to the opening which faces the ridge. By traversing such path inside the cavity defined inside the eave, the fabric can be used to substantially encase the edge of any insulation which is to be installed on top of the fabric in the space between the eave and the next-adjacent purlin.

Purlins 24, eave 20, and ridge 22 extend a few inches beyond the respective end rafter at the end of the building. A rake channel, defining a "C-shaped" cross-section, not shown, is commonly mounted over the ends of the purlins, the eave, and the ridge, at the end of the building whereby the bottom flange of the rake channel is displaced laterally away from the top flange of the rafter. The invention also contemplates that, instead of the longitudinal bands 26 being fastened to the top flange of the corresponding rafter, the longitudinal bands 26 can pass over the top of the upper flange of the rafter, under the lower flange of the rake channel, and wrap about at least one corner of the bottom flange of the rake channel, optionally about the top flange of the rake channel, as illustrated in FIGS. 6A and 7; such longitudinal band being fastened to the rake channel at the respective web or top flange of the rake channel, similar to the fastening shown for the eave in FIGS. 6A and 7.

At the eave, the embodiments of FIG. 6 have the highest probability of failure, though the embodiments of FIG. 6 are satisfactory for some uses. The embodiments of FIG. 6A provide a first level of reduction in stress on the band at screw 66, first by transferring a portion of the band stress to the eave at the remote corner of the lower eave flange, second by transferring some of the stress before that stress reaches the screw aperture.

The embodiments of FIG. 7 provide a second enhanced level of reduction in stress on the band at screw 66, by turning both the first and second corners before the stress reaches the screw aperture.

The embodiments of FIG. 8 provide a third, further enhanced, level of reduction in stress on the band at screw 66. Thus, all else being equal, each turn of the band about any corner enhances the level of stress reduction on the band and enhances the reduction in stress which ultimately reaches screw aperture 60, thus increasing the prospect that the band will survive a fall impact intact, and that the system will successfully catch and hold the falling object.

Thus, referring to the combination of FIGS. 6, 6A, and 7-14, a full implementation of the invention contemplates suspending some, optionally all, of the safety bands 28S from all of the respective purlins using safety clips 52 as illustrated in FIGS. 13-15 and turning some or all of the lateral bands about one or more of the edges of the eave flanges in the process of terminating the respective lateral bands, as illustrated in FIGS. 6A, 7, and 8.

Thus, in a given embodiment, the safety bands are suspended from all of the intermediate purlins by safety dips, and the ends of the safety bands turn at least one corner about the remote edge of the lower flange of the eave before being terminated at one or more screws 66; and the remaining lateral bands (non-safety bands) are fastened to the intermediate purlins, either directly through the suspension fabric through a washer, or fastened to some or all of the intermediate purlins using safety clips. The remaining lateral bands (non-safety bands) may be fastened to each of the intermediate purlins directly through the fabric to the lower flange of the purlin using a screw, or may turn at least one corner about the remote edge of the lower flange of the eave.

In this invention, a given uniform spacing of lateral bands 28 is typically maintained constant between first and second ones of the rafters, plus an additional band, referred to herein as the "safety band", is installed next adjacent each side of each rafter so long as the respective safety band is overlying a portion of the so-suspended fabric. Thus, at the end of the building, a safety band is installed over the end bay adjacent the rafter, but no safety band is installed on the opposite side of the rafter, which is beyond any bay.

As a result of extensive drop testing, the inventors have discovered that the top edges of the rafter flanges may be sharp enough to cut the suspension fabric when a 400 pound test bag is dropped from e.g. 50.5 inches onto conventional fall protection systems, where the bag is dropped such that the edge of the bag is close to the rafter. In a conventional design of the band grid-work, not of this invention, the lateral band closest to the rafter, namely the next adjacent lateral band, is specified to be spaced 6 inches from the rafter, and to extend parallel to the rafter.

The inventors herein have discovered that, when a 400 pound test bag is dropped onto such conventional fall protection system where the band is so spaced 6 inches from the rafter, with the edge of the bag close to the edge of the rafter, only a minor portion of the mass of the bag is between the rafter and the lateral band closest to the rafter. Correspondingly, that closest band is between the rafter and the majority of the mass of the bag. With that closest band thus positioned between the rafter and the majority of the mass of the bag, the force of the fall exerts both a downward force and a substantial transverse force on that closest band. The band responds to the downward force by stretching/elongating and the like, as well as by transferring some of that force to other members of the fall protection system, including to members of the building roof structure.

For example, where the respective band is anchored to an adjacent purlin by an e.g. Tek screw, as in known art, the pulling force on the band may create a longitudinal, sometimes transverse, tear in the band as the band material is pulled longitudinally relative to the stationary screw which extends through the band and into the purlin. Thus, in addition to elongating by plastic deformation of the band material, the band may also tear at an anchoring screw, thereby further elongating the length of band material which is between the respective purlins.

So, even though the band is stressed/tight when impacted by a falling test bag in the known art, the ultimate length of band material between the anchoring purlins at the drop site increases when a test bag impacts the fall protection system. Once the band length increases, the band is no longer tight, no longer extends in a straight line across the space between respective ones of the purlins. With the band no longer tight, the band is readily pushed in a transverse direction, toward the rafter, and typically under the top flange of the rafter. With the band moved out of the way and under the top flange of the rafter, the stress on the fabric becomes a stress applied at the near edge of the top flange of the rafter as the fabric is being pulled downwardly across that near edge of the rafter. Under that stress, and at such angle, the top flange of the rafter is effective to cut through the suspension fabric, whereby the fabric is cut/penetrated by the top edge of the rafter. Such penetration of the fabric is considered a failure of the fall protection system, since the human which the fall protection is intended to protect, could well fall through such hole which has been cut in the fabric, with result that the person intended to be protected by the fall protection system, is indeed not protected by the system.

The inventors herein have discovered that positioning of that closest band, herein called the "safety band" 28S, affects the ability of the fabric to not be cut by the edge of the rafter flange; that the distance between the rafter and the safety band is a determining factor in whether the fabric is cut by the rafter when force is exerted on the fabric by the falling 30-inch wide bag. Position the safety band too close to the rafter and the bag pushes the band toward the rafter, potentially under the top flange of the rafter. With the fabric so exposed to the top edge of the top flange at such downward deflection angle of the fabric, and the fabric is susceptible to being cut by the rafter.

By contrast, position the safety band too far away from the rafter and when the bag is dropped close to the rafter, the band is between the rafter and a minority portion of the mass of the falling bag; the majority of the mass of the falling bag being between the safety band and the rafter. Given such positioning, as the mass falls, much of the transverse portion of the force imposed on the fall protection system is transferred to the safety band, potentially causing the safety band to move away from the respective rafter, whereby a substantial fraction of the force of the fall is imposed on the suspension fabric between the safety band and the top flange of the rafter. Again, the suspension fabric is driven downwardly with force against the edge of the top flange of the rafter with the fabric being pulled downwardly across the near edge of the rafter; with potential that the suspension fabric gets cut by the top flange of the rafter.

In resolving the above failures, the invention herein specifies that the safety band, namely that lateral band which is closest to the rafter, is located no less than 12 inches, and no more than 23 inches, from the respective edge of the top flange of the respective rafter. The purpose of such spacing is to enable the safety band to absorb more of the downward force/impact of the falling bag adjacent the rafter, with limited or no translational movement of the band. If the safety band is less than 12 inches from the top flange of the rafter, the falling bag pushes the safety band so far toward the respective rafter that the suspension fabric may be directly exposed to the cutting edge of the rafter. If the safety band is more than 23 inches from the top flange of the respective rafter, the falling bag pushes the safety band away from the rafter, with the result that there is no banding between the central point of impact and the cutting edge of the rafter. And again, the fabric adjacent the rafter is pulled violently down onto the edge of the top flange of the rafter with substantial potential that the suspension fabric will be cut by the rafter.

Choosing to not be bound by theory, the inventors herein contemplate that the critical factor is to have the band under a central portion of the bag when the bag is positioned, for a drop test, such that the edge of the bag is close to the rafter at impact, such that the translational movement of the band is limited. Namely, if the safety band is generally under the central portion of the bag, the force of the impact is generally transferred to a downward movement of the band whereby downward movement of the fabric, and the down angle of the fabric, adjacent the rafter is lessened such that the fabric is not cut by the rafter. If the central point of the impact is beyond the band, such that the safety band is between the central point of the impact and the rafter, then any translational movement of the bag moves the bag away from the rafter which, again, limits the force on the fabric, thus the downward movement of the fabric, at the rafter, as well as the downward angle at which the fabric interacts with the rafter, enough that the fabric is not cut by the rafter.

When using the OSHA test requirements as the standard for determining the distance between the rafter and the safety band, the test-specified diameter of the bag becomes a determining factor. Where, as in the OSHA requirements, the bag diameter is 30 inches, plus or minus 2 inches, a distance of about 16 inches, optionally about 14 inches to about 18 inches, works well for the distance between the edge of the rafter and the middle of the safety band. In some instances, distances as small as 12 inches, and greater than 18 inches, and up to about 23 inches, from the rafter can be satisfactory, for the safety band.

Given the addition of the safety band, given the overall equi-distant spacing of the remaining bands, from each other and from the rafters, the spacing of the lateral bands can be expressed as follows:

a. The lateral bands, other than the safety bands, are all equally spaced from each other and from the rafters;
b. The safety band is an additional band, not affecting the number, or spacing, of the other bands;
c. The safety bands are spaced from the rafters by first distances different from the second distances between other lateral bands which is different from the distances between the other lateral bands and the rafter systems and;
d. The distance between the safety band (1) and the next adjacent lateral band (2) approximates the distance between the next adjacent band (2) and the next adjacent band (3) which is away from the safety band, less the distance between the safety band (1) and corresponding rafters.

In light of the benefits provided by better positioning of the safety band, the invention provides novel control of the angle and magnitude of the stress exerted on the fabric at the distal edge of the top flange of the rafter.

In the invention, a safety band is thus located adjacent each side of each rafter, where such band is to be overlaid by the suspension fabric to thus support a falling object.

The safety band is an additional band, in addition to the number of lateral bands which would otherwise be used across a given bay, between the first and second rafters. Accordingly, where the bay spacing normally calls for a lateral band e.g. 36-40 inches from the first rafter, that lateral band is installed at the specified distance, and an additional band is installed, as the safety band, at a distance of 12-23 inches, optionally 14-18 inches, optionally 16 inches from the rafter.

Thus, where the bay width, between rafters is 25 feet (300 inches), with a maximum distance between bands being 40 inches, the theoretical number of spaces between bands is 300/40=7.5 spaces, thus 6.5 bands. Accordingly, 7 lateral bands are indicated across the bay, without considering the safety bands. The 7 "typical" lateral bands are spaced 37.5 inches apart. In addition, the 2 safety bands, one on each side of the bay, are next adjacent the respective rafters. Accordingly, the two bands closest to a given rafter are 16 inches (the safety band) and 37.5 inches from the rafter. Thus, the distance from the rafter to the safety band is 16 inches, the distance from the safety band to the next adjacent band is 21.5 inches, and the distance from the next adjacent lateral band to the third lateral band from the rafter, is 37.5 inches.

Figure 16:
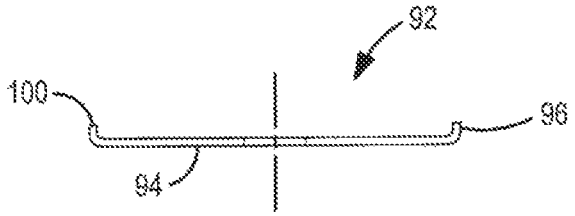
FIG. 16 is an edge view of a slip clip of the invention.
Figure 17:
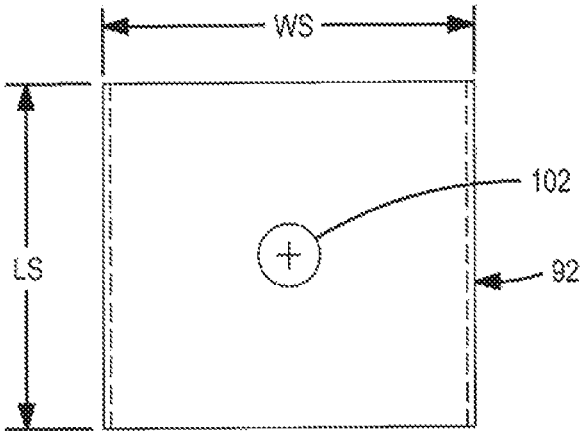
FIG. 17 is a plan view of the slip clip of FIG. 16.
Figure 18:
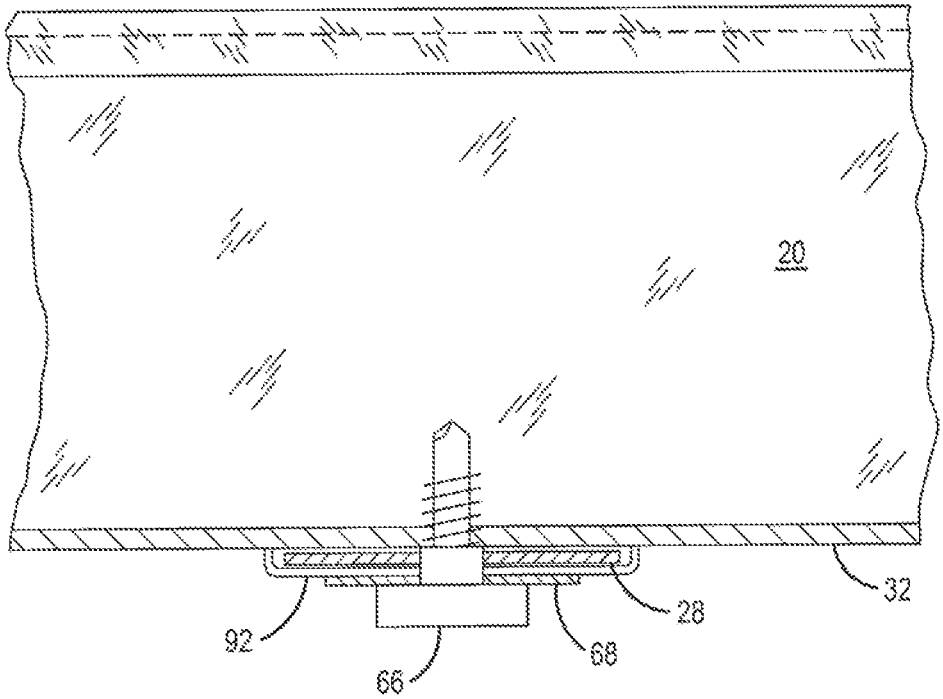
FIG. 18 is an elevation view, with parts cut away, of the slip clip of FIGS. 16 and 17 installed at the bottom flange of an eave.

FIGS. 16-18 illustrate a slip clip 92 which can be used at any location where a screw 66 is used to anchor a band. Slip clip 92 has a base leg 94 extending the length "LS" and width "WS" of clip 92. First and second relatively short return legs 96 have lengths corresponding to the length of the slip clip. Return legs 96 extend from opposing ends of the base leg, turning upwardly from the base leg. When the main leg is oriented horizontally, remote ends 100 of the return legs face upwardly and are spaced at elevations which are above the upper surface of the main leg by the thickness of the respective band 26 or 28, plus just enough additional elevation to allow the respective band to slide freely longitudinally between the upper surface of main leg 94 and the lower surface of the suspension fabric or e.g. the bottom flange 36 of eave 20. A central aperture 102 extends through base leg 94 between remote ends 100 of the return legs.

While length "LS" of the slip clip is of only passing importance, the width "WS" of the slip clip is sized much like opening 64 through the safety clip, to restrict transverse movement of the respective lateral band.

When a lateral band is first drawn from the ridge to the eave, the eave end of the band is tightened and may be temporarily mounted to the eave using e.g. a releasable clamp. After attachments, securements have been made at any intermediate purlins, the releasable clamp at the eave is released and the band is permanently mounted to the eave with a screw 66. Multiple embodiments are shown for mounting the band to the eave at FIGS. 6, 6A, 7, and 8.

In those embodiments where a slip clip is used, prior to the band being permanently attached to the eave, the slip clip is mounted over the band, with the return legs disposed to face the lower surface of the bottom flange of the eave, optionally facing the lower surface of the suspension fabric where the suspension fabric is placed between the band and the surface of the eave. The screw 66 used to mount the band to the eave, whether at bottom flange 36, web 38, top flange 34, or return flange 76, is then driven through both the slip clip and the band.

The benefit of the slip clip is that, as the band is stressed during a fall/impact, the location of maximum stress on the band is at the hole in the band where screw 66 mounts the band to the eave. Under the extreme stress of the impact, the band can tear longitudinally at that hole as the stress attempts to elongate the band. Without use of a such slip clip, such tearing can propagate both longitudinally and across the width of the band, with the result that the screw can tear out the side of the band. Return legs 100 of slip clip 92 prevent any transverse movement of the band, thus prevent propagation of such tearing across the width of the band, as the width of the slip clip between return legs 100 is only nominally greater than the width of the band, thus to essentially preclude transverse movement of the band during any such elongation while accommodating limited longitudinal movement/tearing of the band.

Where, as in the case of the safety band, the band is not screw-mounted to the intermediate purlins, any temporary mounting of the band to the eave is typically not dependent on any screw-mounting of the band to any intermediate purlin. Accordingly, where, and only where, the slip clip is used, the slip clip is typically mounted to the band before the respective band is mounted to the eave; such that the slip dip is essential to the permanent mounting of the band to the eave.

While the slip clip has been described in terms of use at the eave, where a screw 66 is used to mount a lateral band to the eave, the slip clip may be used anywhere a band is anchored to a roof structure element by a screw 66. Thus, slip clip 92 can be used with any or all of the screws 66 which extend through the band at an intermediate purlin. For example, in FIG. 15, slip clip can be used with any screw 66 which is used to attach band 28 directly to the overlying purlin, thus to control both longitudinal and transverse mobility of the band. However, slip clip 92 is not used at any screw 66 which attaches a safety clip 52 to an overlying purlin. As another example, a slip clip can be used to mount a longitudinal band 26 to the top of a rafter, either an intermediate rafter or a rafter at an end of the band. In such use, the return legs 96 of the slip clip are oriented to extend downwardly from main leg 94 such that the return legs are between the ends of the main leg and the top surface of the rafter, and the respective longitudinal band is between the main leg and the rafter.

Method of Installing Fall Protection

Installation of a fall protection system of the invention begins after the columns, rafters, ridges, eaves, and intermediate purlins are in place about at least a given bay. Typically, installation of the fall protection system begins after erection/emplacement of all of the columns, rafters, ridges, eaves, and purlins.

Installation of the fall protection system begins by installing longitudinal bands 26. A given longitudinal band is installed by unwinding band material from a roll and extending the band material over the tops of the respective rafters and across a given bay or bays. At least one longitudinal band is extended, between each next-adjacent pair of purlins to at least the next rafter. The longitudinal band is manually stretched tight with hand tools, and the so-tightened band is fastened to the respective rafters with Tek screws after which the band is cut to length. As illustrated in the drawings, the longitudinal bands typically extend perpendicular to the rafters. The so-partially-installed, tightened, longitudinal bands extend from rafter to rafter at generally the height of the tops of the rafters, but some nominal amount of sag of the longitudinal bands exists between the rafters at this stage of installation.

Typically, the purlins are spaced no more than 5 feet apart. In this invention, typically a single longitudinal band is installed between each pair of next-adjacent purlins so long as the purlin spacing is no more than the typical maximum of 5 feet. Where the purlin spacing approaches, or exceeds, the typical 5-feet maximum, an additional longitudinal band 26 may be used in one or more of the spaces between the purlins.

Once the longitudinal bands 26 have been emplaced and tightened, banding for lateral bands 28 is unrolled under the longitudinal bands, and one end of the banding is secured to the respective ridge or purlin, or to an opposing eave. The lateral banding material is extended to the eave and then tightened sufficiently to raise both the lateral band and the overlying longitudinal bands into close proximity with the intermediate purlins. This process is repeated along the width of the bay, e.g. between the rafters, until the desired number of lateral bands has been emplaced across the width of the bay.

With the band grid system thus temporarily in place, a zigzag-folded roll of the suspension fabric is elevated to the height of the rafters, typically adjacent a rafter at an end of the building or bay. The fabric is then unrolled on top of the band grid in one of the spaces between next-adjacent ones of the purlins such that one end of the fabric faces the eave and the opposing end of the fabric faces the ridge. The ends of the fabric are then pulled, individually, toward the eave and the ridge, working the leading ends of the fabric under the intervening purlins and above the band grid. The initial phase of the process of so-extending the fabric is illustrated in FIG. 3.

Once the fabric has been generally extended the full length and width of the bay over which the fabric is to be suspended, over the band grid and under the intermediate purlins, the lateral bands are then attached to the intermediate purlins, beginning at the ridge and working toward the eave. The method of such attachment at each intersection of band and purlin is determined by the fall protection system which has been designed for, specified for, that particular building. In a typical design, the safety bands 28S are attached to each purlin using safety clips 52.

For example, a safety clip such as that shown in FIGS. 10A and 10B is slipped transversely across the safety band such that an edge of the safety band is located proximate bight 58. The safety clip, with resident safety band proximate bight, is positioned against the lower surface of the suspension fabric with apertures 60 aligned with the lower flange of the corresponding intermediate purlin. A self-drilling Tek screw 66 is then driven through apertures 60, through fabric 32, and into the lower flange of the purlin. As the screw is driven tight against the bottom surface of the fabric, driving the fabric against the bottom surface of the lower flange of the purlin, the space between legs 54 and 56, of clip 52, closes, thus defining the two-layer flange 67 illustrated in e.g. FIGS. 11 and 12. Screws 66 are then driven through the remaining lateral bands 28 at each purlin, fastening the lateral bands directly to the purlins as illustrated in FIG. 13.

Once the attachments to the intermediate purlins have been completed, the temporary attachments of the bands to the eave are released, and the fabric is worked up alongside the eave, such as alongside web 38, top flange 34, and/or top flange return 76, with the fabric thus between the eave and the respective lateral bands. With the fabric thus in place, each band is again stretched against the eave and permanently fastened to the eave at the respective location on the eave, according to the embodiment being implemented, whether the embodiment of FIG. 6, the embodiment of FIG. 6A, the embodiment of FIG. 7, or the embodiment of FIG. 8.

Sides of the fabric are then cut around the purlins at each rafter, as known in the art, and edges of the fabric are secured to the top surfaces of the rafter such as by adhesive, also as known in the art.

With both the longitudinal and lateral bands so secured to the roof structure; with the fabric so secured to the ridge and eave by the lateral bands and secured to the rafters by e.g. adhesive, installation of the fall protection system of the invention is thus complete and ready to protect workers who subsequently install other elements of the building while working at the roof elevation; such elements as the roof insulation and the roof panels.

Suspension fabric 32, which in the preferred embodiment consists of a vapor barrier material, is fabricated/converted to size before installation. The suspension fabric is installed one bay 18 at a time and, in the case of large buildings or buildings with high gables, fabric 32 for each half of the bay may be divided at ridge 22 and may be installed separately.

The suspension fabric has been converted/fabricated, prior to installation, to a size having a dimension a few inches longer and a few inches wider, at each edge, than the dimensions of the bay to be overlaid, as known in the art, and is Z-folded for easy spreading above the band grid. For this purpose a zigzag type fold, as shown in FIG. 3, is easiest to work with, although other rolling or folding arrangements can also be used and are within the scope of the invention.

Method of Converting the Suspension Fabric

Figure 9:
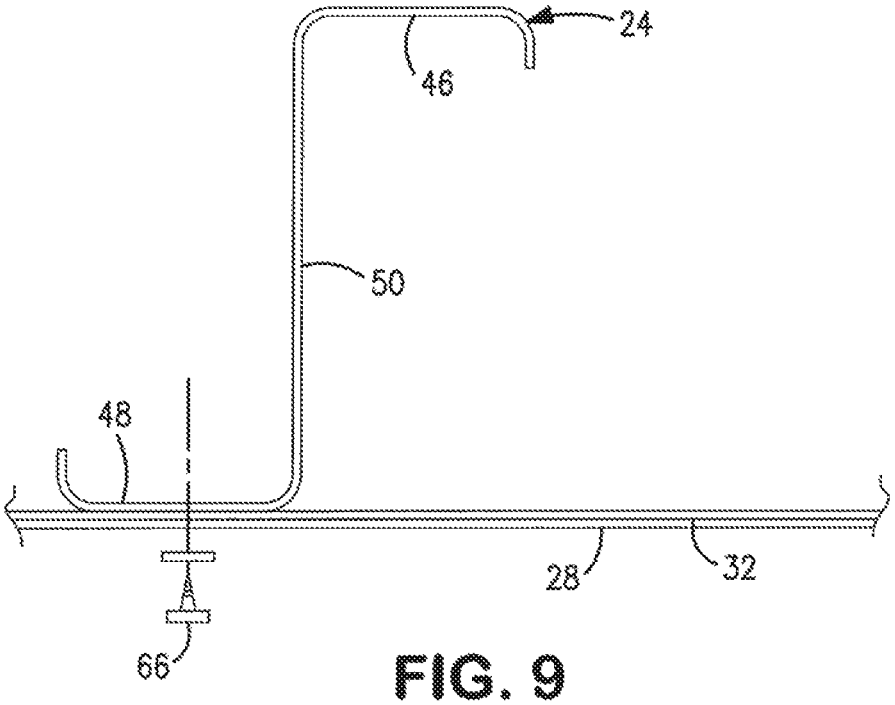
FIG. 9 shows a cross-section of an intermediate purlin, and a Tek screw, with washer, positioned to extend the screw through the fabric and into the purlin bottom flange.
Figure 19:
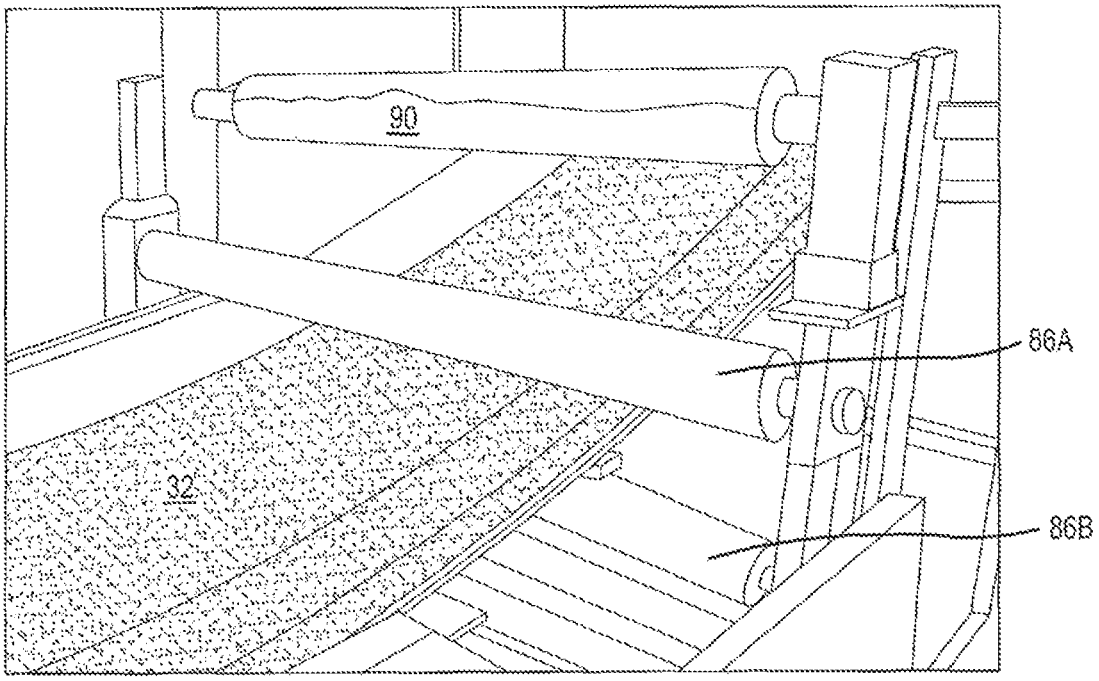
FIG. 19 is a photograph, showing a perspective view of a pair of separated nip rolls at a fabrication work station where substantially all the air can be expelled from a Z-folded suspension fabric prior to the fabric being rolled up as a roll onto a core.
Figure 20:
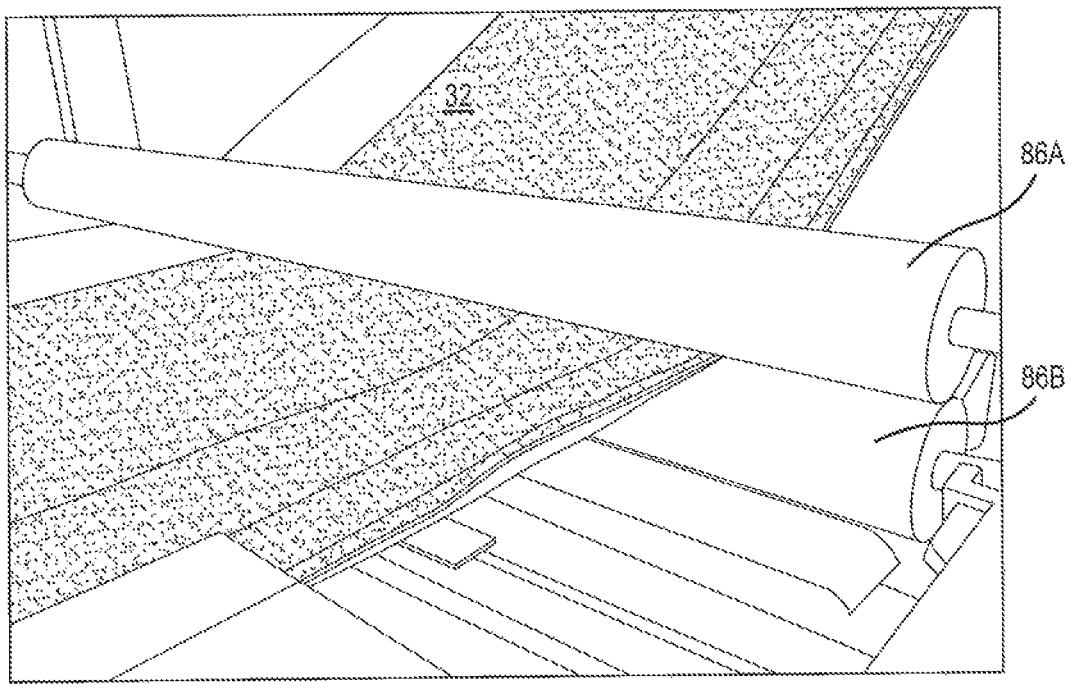
FIG. 20 is a photograph showing the work station of FIG. 19 after the nip rolls have been brought together on a length of the fabric which is being processed.

FIGS. 19-23 show a Z-folded fabric 32 laid out along a production line 82, with the fabric being supported by a work table 84, as the fabric is being fabricated into a roll product. FIG. 9 shows how the fabric 32 passes between first and second nip rolls 86A and 86B. FIG. 20 shows the nip rolls dosed on the fabric. As the fabric advances through the nip rolls, the pressure between the nip rolls expels substantially all of the air from between the layers of the Z-folded fabric.

Figure 21:
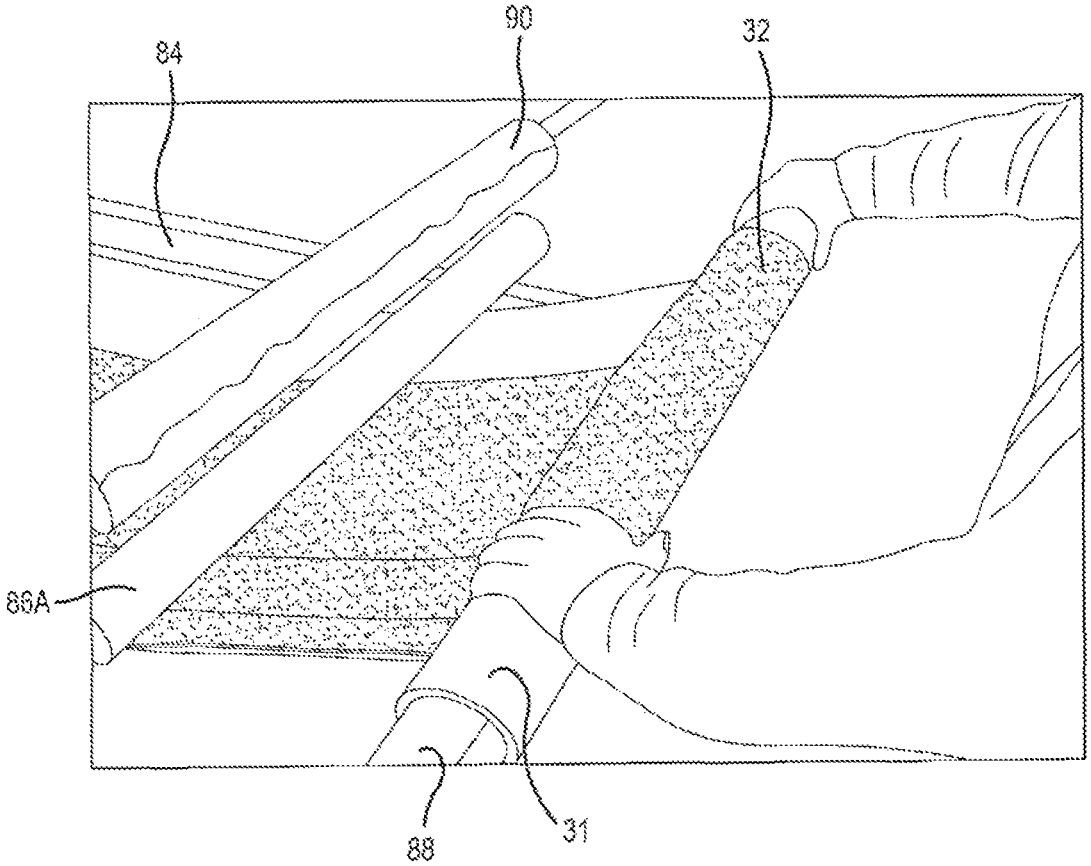
FIG. 21 is a photograph showing a winder, downstream of the nip rolls, where a leading edge of the Z-folded fabric has been wound about the core.

FIG. 21 shows the same work area as FIGS. 19 and 20, from a downstream direction relative to FIGS. 19 and 20, looking back upstream along the processing line. FIG. 21 shows a worker initiating winding of the Z-folded fabric 32 on a 3-inch cardboard core 31 mounted on a winder 88. With substantially all the air expelled from the Z-folded fabric at nip rolls 86A, 86B, the fabric can be tightly wound on core 31 by winder 88.

FIG. 21 further shows a roll of protective plastic 90 mounted essentially above nip rolls 86A, 86B and upstream of winder 88, but within reach of a worker standing behind the winder.

Figure 22:
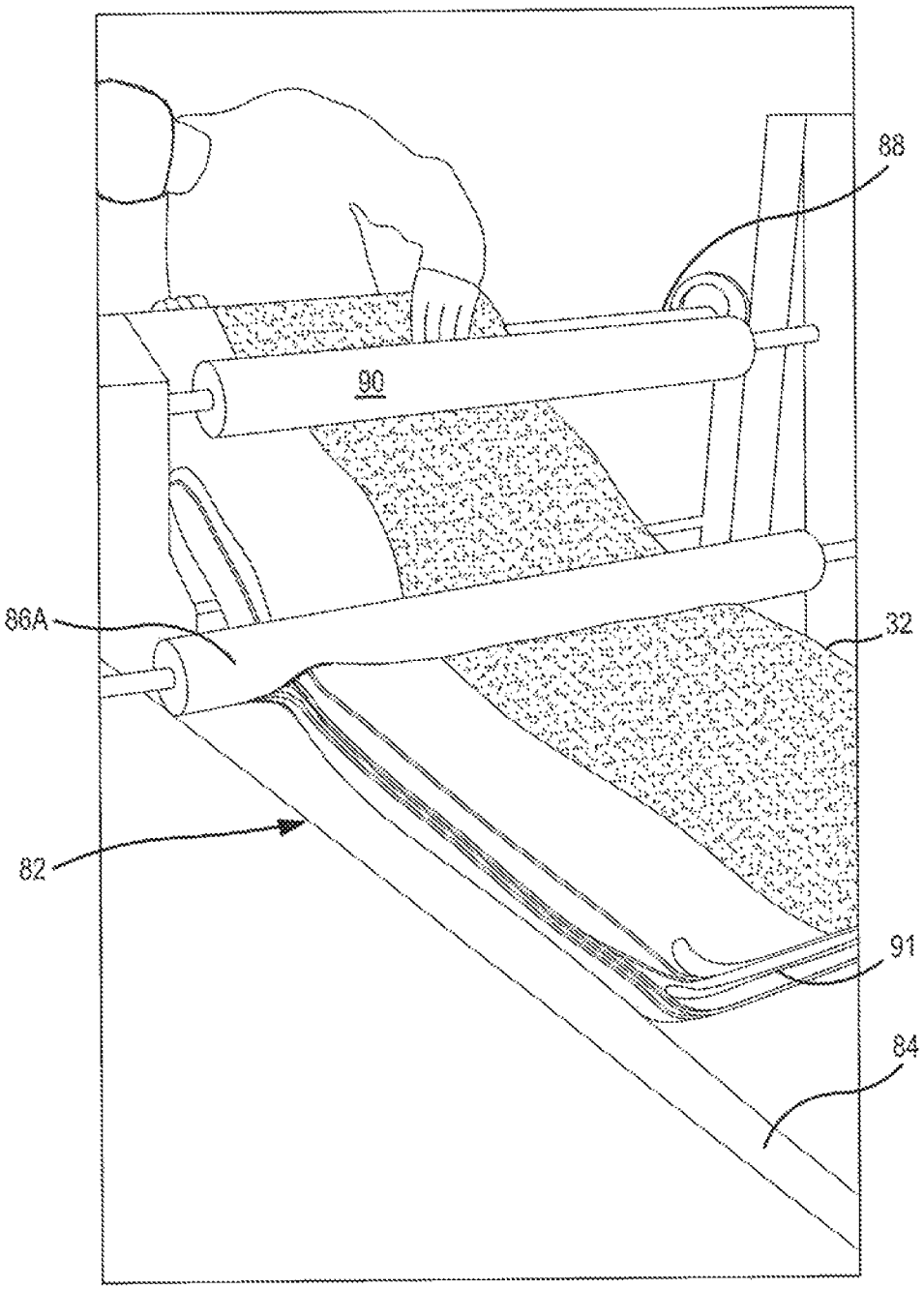
FIG. 22 is a photograph showing both the nip rolls and the winder, and a roll of protective plastic mounted essentially over the nip rolls and upstream of the winder, as the trailing edge of the Z-folded fabric approaches the nip rolls.
Figure 23:
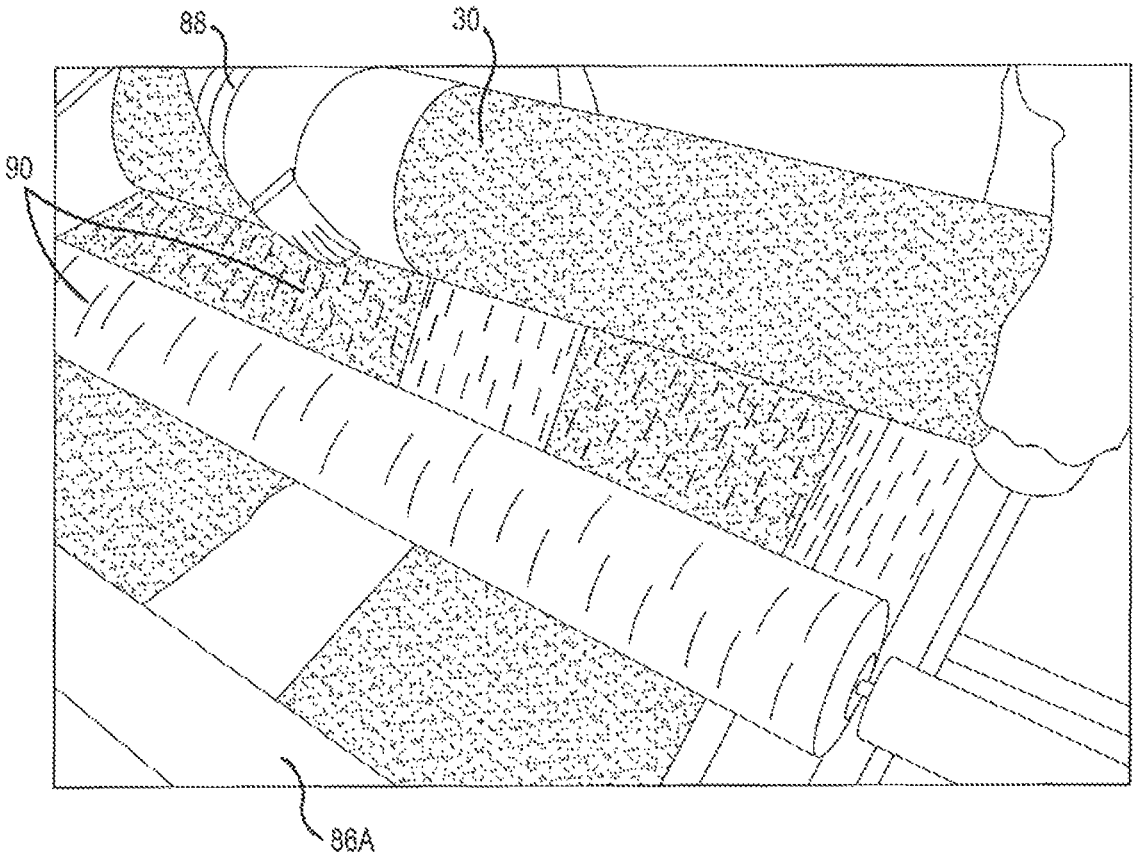
FIG. 23 is a photograph showing the nip rolls closed on the Z-folded fabric to create a nip squeezing the fabric, the winder receiving the nip, and a roll of protective plastic mounted essentially over the nip and upstream of the winder, and a worker feeding a leading edge of the protective plastic into the nip formed between the fabric on the roll and the fabric being fed onto the roll.
Figure 24:
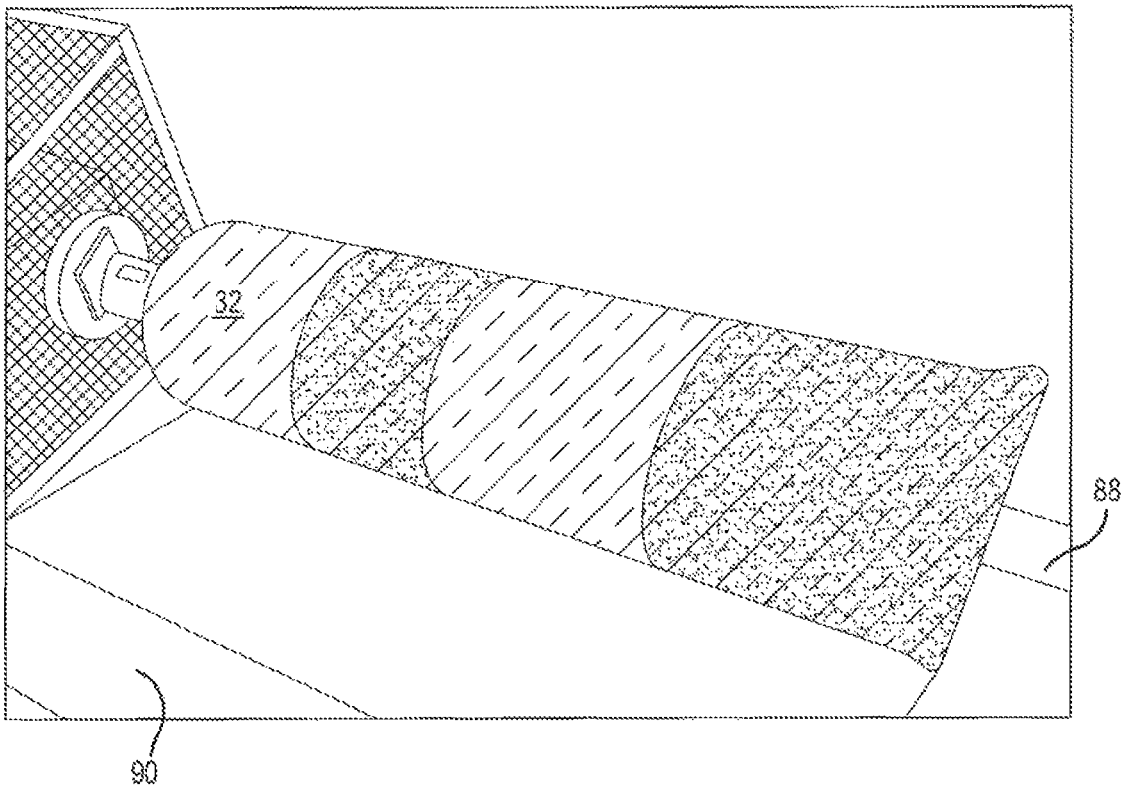
FIG. 24 is a photograph showing the finished roll product, wrapped in the protective plastic, still on the winder.
Figure 25:
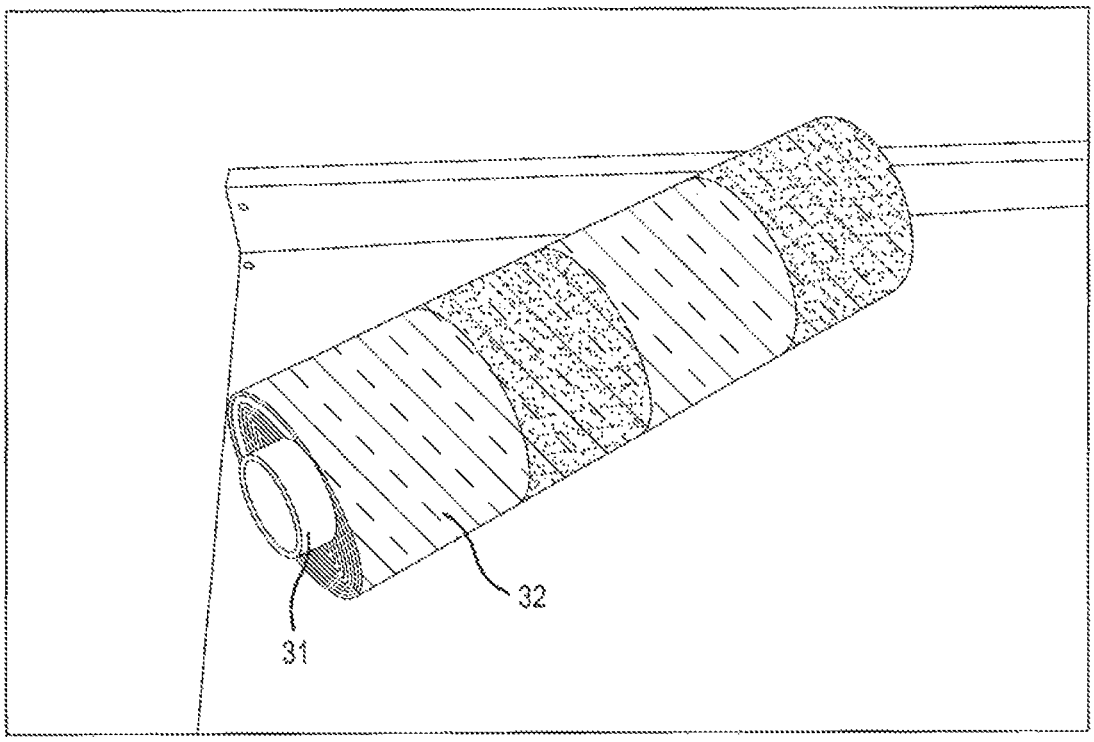
FIG. 25 is a photograph showing the finished roll product, removed from the winder.

FIG. 22 shows the winding operation temporarily stopped as the trailing edge 91 of the Z-folded fabric approaches the closed nip rolls. FIG. 23 shows the worker feeding a leading edge of protective plastic 90 into the nip formed between the fabric which is on the roll and the fabric which is approaching the roll. FIG. 24 shows the finished roll, still on the winder, where the trailing edge of the Z-folded fabric has been wound up on the roll, with a layer of the protective plastic wrapped about the outer surface of the fabric on the roll with the protective plastic film still connected to both the plastic feed roll and the roll of fabric. FIG. 25 shows the roll after the protective plastic has been cut, separating the plastic feed roll from the plastic-protected roll of fabric.

The process of producing the rolled suspension fabric product is generally as follows.

Multiple lengths of the fabric are cut from a roll of fabric having an indefinite length. The lengths of such multiple lengths of fabric correspond to the specified length of fabric needed for the length of a particular bay of a building which is to be constructed. The multiple lengths of fabric are then seamed together longitudinally to the specified width, and any excess width is trimmed from the resultant seamed fabric. The so-seamed and so-trimmed fabric is then Z-folded in known manner such that the folds in the fabric extend in the direction of the width of the bay of the building, for which bay the fabric has been fabricated whereby the turns/folds in the so-folded fabric extend in the direction of the length of the bay of the building, for which bay the fabric has been fabricated.

The Z-folded fabric is then transferred to elongate work table 84 with the length of the Z-folded fabric extending along the length of the work table. At the work table, nip rolls 88A, 868 are checked to be sure the nip rolls are separated. If the nip rolls are not separated, the rolls are separated from each other before proceeding further. With the nip rolls separated, the leading edge of the fabric on the work table is fed through the nip between the nip rolls as illustrated in FIG. 19 and is drawn up to, and secured to winder 88 with e.g. a piece of tape or other releasable securement.

With the Z-folded fabric thus threaded between the nip rolls and onto the winder, the nip rolls are brought together as illustrated in FIG. 20 such that, as the Z-folded fabric passes through the nip, essentially all air is expressed, squeezed, from between the layers of the fabric. Winder 88 is then powered, driving the winder and correspondingly drawing the Z-folded fabric through the nip at nip rolls 86A, 86B. The nip rolls squeeze the air out of the Z-folded fabric thereby flattening any spaces between the layers of fabric. FIG. 22 illustrates the Z-folded fabric upstream of the nip rolls, where it is seen that, at the trailing edge of the fabric, the layers are spaced from each other at the 180 degree turns of the fabric. The nip rolls squeeze out the air at those turns, thus flattening the Z-folded fabric. The winder maintains a draw tension on the fabric between the nip rolls and the winder whereby the winder winds up the so-flattened fabric while the fabric is still flattened such that the layers of fabric, as wound, are tightly against each other on the roll. The result is a relatively compact, relatively dense roll substantially devoid of surface air between the layers.

As the trailing end of the fabric approaches the nip between rolls 86A and 86B, the operator stops the winding process. With the winding stopped, the operator feeds a leading edge of the protective plastic 90, from the roll of protective plastic, into the nip between the fabric on the wound roll and the fabric which is approaching the roll. With that protective plastic in place in the nip, the winding is resumed. When the winding is resumed, the winder draws the remaining portion of the Z-folded plastic onto the roll while also drawing the protective plastic onto the roll, with the result that, when the trailing edge of the Z-folded fabric has been wound up on the roll, the protective plastic continues to wind onto the roll of fabric, fed from the roll of protective plastic. The purpose of the protective plastic is to protect the fabric which has been wound onto the roll. Once the trailing edge of the fabric has been wound up on the roll, a shipping label can, if desired, be fed into the roll and further covered with one or more layers of the protective plastic which is subsequently wound onto the roll. When a suitable quantity of protective plastic has been wound onto the roll, optionally over the shipping label, the winding operation is stopped and the protective plastic is severed. The loose end of the protective plastic on the roll is secured, such as by friction, or by mutual attraction of layers of the plastic for each other, or by tape.

The so-wound roll is then removed from the winder. The so-removed roll is illustrated in FIG. 25, ready for shipment to the construction site. At the construction site, a shaft 33 is inserted through core 31, and the fabric roll is lifted to the installation elevation, and temporarily mounted to respective ones of the purlins for dispensing of the fabric across a building bay as discussed herein above and as illustrated in FIG. 3.

The fall protection systems of the invention are designed to be of sufficient strength to catch and support a man's weight, generally between 250 and 400 pounds. The system is tested by dropping a 400 lb. weight with the center of gravity of the weight, before the weight is dropped, being 42 inches above a worker's walking height, thus 42 inches plus the height of the purlins, namely about 50.5 inches above the fabric. To pass the test, the system must stop the falling weight at any point in the bay which is so protected. In one test specified by OSHA, 400 lb. of washed gravel or sand is placed into a reinforced bag that can tolerate being dropped repeatedly. The test bag is 30 inches in diameter, plus or minus 2 inches. The 400 pound bag is hoisted above the fall protection system to a height of 42 inches above the plane of the intermediate purlins, measuring from the center of the so-filled bag. A cord supporting the weight of the bag is then released, allowing the weight to free fall in one concentrated load. The weight can be dropped onto any part of the fall protection system to test different areas.

Although the invention has been described with respect to various embodiments, it should be realized this invention is also capable of a wide variety of further and other embodiments within the spirit and scope of the appended claims.

Those skilled in the art will now see that certain modifications can be made to the apparatus and methods herein disclosed with respect to the illustrated embodiments, without departing from the spirit of the instant invention. And while the invention has been described above with respect to the preferred embodiments, it will be understood that the invention is adapted to numerous rearrangements, modifications, and alterations, and all such arrangements, modifications, and alterations are intended to be within the scope of the appended claims.

To the extent the following claims use means plus function language, it is not meant to include there, or in the instant specification, anything not structurally equivalent to what is shown in the embodiments disclosed in the specification.

Having thus described the invention, what is claimed is:

1. A fall protection system in a building roof structure, said building roof structure including structural roof elements which include at least first and second rafters, a space between said first and second rafters defining a first distance between said first and second rafters, each said rafter having a length, a top, and opposing first and second ends, said roof structure further comprising an eave, having a length, and extending between the first ends of said first and second rafters, a ridge, having a length, and extending between the second ends of said first and second rafters, and a second distance between said eave and said ridge, said eave and said ridge being disposed on, and extending transverse to, and being connected to, the tops of said first and second rafters, and a plurality of intermediate purlins extending between said first and second rafters and spaced from each other between said eave and said ridge, said intermediate purlins being disposed on, and extending transverse to, the tops of said first and second rafters, said fall protection system comprising:

(a) a first set of longitudinal support bands extending from said first rafter to said second rafter and being connected to said building structural roof elements, said first set of longitudinal support bands being spaced along the lengths of said first and second rafters;

(b) a second set of lateral support bands extending from said eave toward said ridge and under said intermediate purlins, said lateral bands of said second set of support bands having first and second end portions which are spaced along the lengths of said eave and said ridge; and (c) a suspension fabric overlying, and being supported by, said first and second sets of support bands, and being attached to said building structural roof elements, a first band of said second set of lateral support bands, next adjacent said first rafter, comprising a safety band, spaced from said first rafter by a distance of 12 inches to 23 inches, such that when a 400 pound bag, 30 inches diameter, is dropped such that an edge of the bag is close to said first rafter at impact, the force of the impact is transferred to a downward movement of the safety band whereby downward movement of the fabric is lessened, compared to a system where said safety band is six inches from said first rafter, such that the fabric is not cut by said first rafter, said safety band extending from said ridge to said eave under each of said intermediate purlins, and being anchored attached, for restraint of longitudinal movement of said safety band, at less than all of said intermediate purlins, whereby the amount of the force of a falling such 400 pound bag which must be dissipated by any one member of the fall protection system is reduced, compared to a system wherein the safety band is anchored to each said intermediate purlin crossed by said safety band.

2. A fall protection system as in claim 1, said safety band being anchored attached, for restraint of longitudinal movement of said safety band, only at opposing first and second ends of said safety band.

3. A fall protection system as in claim 2, a safety clip being anchored attached to each of said intermediate purlins, said safety clip, at a given said purlin, either alone or in combination with said intermediate purlin, defining an opening through said safety clip at or adjacent the given said intermediate purlin, said safety band extending through said opening, wherein sides of said opening confine said safety band in said opening against substantial transverse movement of said safety band while accommodating generally unrestricted longitudinal movement of said safety band through said opening.

4. A fall protection system as in claim 3, said safety band extending through a slip clip at said eave, and being secured to said eave through said slip clip, said slip clip having a length and a width, and comprising a main leg having opposing sides, and return legs extending across the width of said slip clip from the opposing sides and overlying, and being spaced from said main leg, said first band being confined against transverse movement of said first band between said main leg and said return legs.

5. A fall protection system as in claim 3, said safety band having at least one of (i) a yield strength of 45 ksi to 85 ksi, or (ii) a tensile strength of 60 ksi to 90 ksi, or (iii) an elongation of 12 percent to 40 percent.

6. A fall protection system as in claim 3, said safety band having (i) a yield strength of 45 ksi to 75 ksi, and (ii) a tensile strength of 65 ksi to 85 ksi, and (iii) an elongation of 22 percent to 37 percent, and (iv) Rockwell B hardness of 64 to 79.

7. A fall protection system as in claim 3, said safety band having (i) a yield strength of 51 ksi to 64 ksi, and (ii) a tensile strength of 65 ksi to 78 ksi, and (iii) an elongation of 22 percent to 37 percent, and (iv) Rockwell B hardness of 64 to 79.

8. A fall protection system as in claim 3, said safety band having (i) an average yield strength of about 58 ksi, and (ii) an average tensile strength of about 72 ksi, and (iii) an average elongation of about 31 percent, and (iv) an average Rockwell B hardness of about 72.

9. A fall protection system as in claim 1, said safety band being spaced from said first rafter by a distance of 14 inches to 18 inches.

10. A fall protection system as in claim 1, said safety band being spaced from said first rafter by a distance of 15 inches to 17 inches.

11. A fall protection system as in claim 3, said safety clips being anchored to said intermediate purlins on alternating sides of said safety band.

12. In a roof structure of a building, said roof structure including structural roof elements which include at least first and second rafters, each rafter having a length, a top, and opposing first and second ends, the roof structure further comprising an eave, having a length, and extending between the first ends of the first and second rafters, a ridge, having a length, and extending between the second ends of the first and second rafters, and a plurality of intermediate purlins extending between the first and second rafters and spaced from each other between the eave and the ridge, the eave, the ridge, and the intermediate purlins being disposed on, and extending transverse to, the tops of the first and second rafters, a method of enhancing a prospect of passing a drop test wherein a 400 pound load is dropped from 50.5 inches above a suspension fabric of a fall protection system such that an edge of the load impacts the suspension fabric within 6 inches of a building rafter, the method comprising installing (a) a first set of longitudinal support bands extending from the first rafter to the second rafter and being connected to the building structural roof elements, the first set of longitudinal support bands being spaced along the lengths of the first and second rafters;

(b) a second set of lateral support bands extending from the eave toward the ridge and under the intermediate purlins, the lateral bands of the second set of support bands having first and second end portions which are spaced along the lengths of the eave and the ridge; and (c) a suspension fabric overlying, and being supported by, the first and second sets of support bands, and being attached to the building structural roof elements, a first band of the second set of lateral support bands, next adjacent the first rafter, comprising a safety band and being spaced from the first rafter by a distance of 12 inches to 23 inches, and having at least one of (i) a yield strength of 45 ksi to 85 ksi, or (ii) a tensile strength of 60 ksi to 90 ksi, or (iii) an elongation of 12 percent to 40 percent, the safety band extending from the ridge to the eave under each of the intermediate purlins, and being anchored attached, for restraint of longitudinal movement of the safety band, only at opposing first and second ends of the safety band, whereby the amount of the force of a falling such 400 pound bag which must be dissipated by any one member of the fall protection system is reduced, compared to a system wherein the safety band is anchored to each said intermediate purlin crossed by said safety band.

13. A method as in claim 12, further comprising anchoring a safety clip to each of the intermediate purlins, the safety clip, at a given purlin, either alone or in combination with the intermediate purlin, defining an opening through the safety clip at or adjacent the given intermediate purlin, the safety band extending through the opening, wherein sides of the opening confine the safety band in the opening against substantial transverse movement of the safety band while accommodating generally unrestricted longitudinal movement of the safety band through the opening.

14. A method as in claim 13, further comprising the safety band having (i) a yield strength of 51 ksi to 64 ksi, and (ii) a tensile strength of 65 ksi to 78 ksi, and (iii) an elongation of 22 percent to 37 percent, and (iv) Rockwell B hardness of 64 to 79.

15. A method as in claim 13, further comprising the safety band having (i) an average yield strength of about 58 ksi, and (ii) an average tensile strength of about 72 ksi, and (iii) an average elongation of about 31 percent, and (iv) an average Rockwell B hardness of about 72.

16. A method as in claim 15, further comprising the safety band spaced from the first rafter by a distance of 14 inches to 18 inches.

17. A method as in claim 15, further comprising the safety band spaced from the first rafter by a distance of 15 inches to 17 inches.

18. A method as in claim 13, including mounting the safety clips to the overlying intermediate purlins on alternating sides of the safety band.

19. In a roof structure of a building, said roof structure including structural roof elements which include at least first and second rafters, each rafter having a length, a top, and opposing first and second ends, the roof structure further comprising an eave, having a length, and extending between the first ends of the first and second rafters, a ridge, having a length, and extending between the second ends of the first and second rafters, and a plurality of intermediate purlins extending between the first and second rafters and spaced from each other between the eave and the ridge, the eave, the ridge, and the intermediate purlins being disposed on, and extending transverse to, the tops of the first and second rafters, a method of enhancing a prospect of passing a drop test wherein a 400 pound load is dropped from 50.5 inches above a suspension fabric of a fall protection system such that an edge of the load impacts the suspension fabric within 6 inches of a building rafter, the method comprising installing, in said building, a fall protection system, comprising:

(a) a first set of longitudinal support bands extending from the first rafter to the second rafter and being connected to the building structural roof elements, the first set of longitudinal support bands being spaced along the lengths of the first and second rafters;

(b) a second set of lateral support bands extending from the eave toward the ridge and under the intermediate purlins, the lateral bands of the second set of support bands having first and second end portions which are spaced along the lengths of the eave and the ridge; and (c) a suspension fabric overlying, and being supported by, the first and second sets of support bands, and being attached to the building structural roof elements, a first band of the second set of lateral support bands, next adjacent the first rafter, comprising a safety band and being spaced from the first rafter by a distance of 12 inches to 23 inches, such that when a 400 pound bag, 30 inches diameter, is dropped such that an edge of the bag is close to said first rafter at impact, the force of the impact is transferred to a downward movement of the safety band whereby downward movement of the fabric is lessened, compared to a system where said safety band is six inches from said first rafter, such that the fabric is not cut by said first rafter, and having at least one of (i) a yield strength of 45 ksi to 85 ksi, or (ii) a tensile strength of 60 ksi to 90 ksi, or (iii) an elongation of 12 percent to 40 percent, the safety band extending from the ridge to the eave under each of the intermediate purlins, and being anchored attached, for restraint of longitudinal movement of the safety band, only at opposing first and second ends of the safety band, whereby the amount of the force of a falling such 400 pound bag which must be dissipated by any one member of the fall protection system is reduced, compared to a system wherein the safety band is anchored to each said intermediate purlin crossed by said safety band.

20. A method as in claim 19, further comprising anchoring a safety clip to each of the intermediate purlins, the safety clip, at a given purlin, either alone or in combination with the intermediate purlin, defining an opening through the safety clip at or adjacent the given intermediate purlin, the safety band extending through the opening, wherein sides of the opening confine the safety band in the opening against substantial transverse movement of the safety band while accommodating generally unrestricted longitudinal movement of the safety band through the opening.

21. A method as in claim 20, further comprising said safety band having (i) a yield strength of 51 ksi to 64 ksi, and (ii) a tensile strength of 65 ksi to 78 ksi, and (iii) an elongation of 22 percent to 37 percent, and (iv) Rockwell B hardness of 64 to 79.

22. A method as in claim 20, further comprising said safety band having (i) an average yield strength of about 58 ksi, and (ii) an average tensile strength of about 72 ksi, and (iii) an average elongation of about 31 percent, and (iv) an average Rockwell B hardness of about 72.

23. A method as in claim 22, further comprising spacing said safety band from the first rafter by a distance of 14 inches to 18 inches.

24. A method as in claim 22, further comprising spacing the safety band from the first rafter by a distance of 15 inches to 17 inches.

25. A method as in claim 20, including anchoring the safety clip to the overlying intermediate purlins on alternating sides of the safety band.

26. In a roof structure of a building, said roof structure including structural roof elements which include at least first and second rafters, each rafter having a length, a top, and opposing first and second ends, the roof structure further comprising an eave, having a length, and extending between the first ends of the first and second rafters, a ridge, having a length, and extending between the second ends of the first and second rafters, and a plurality of intermediate purlins extending between the first and second rafters and spaced from each other between the eave and the ridge, the eave, the ridge, and the intermediate purlins being disposed on, and extending transverse to, the tops of the first and second rafters, a method of protecting construction workers against accidental injury resulting from falls from elevation, the method comprising:

installing a fall protection system comprising a first set of longitudinal support bands extending from the first rafter to the second rafter and being connected to the building structural roof elements, the first set of longitudinal support bands being spaced along the lengths of the first and second rafters, a second set of lateral support bands extending from the eave toward the ridge and under the intermediate purlins, the lateral bands of the second set of support bands having first and second end portions which are spaced along the lengths of the eave and the ridge, and a suspension fabric overlying, and being supported by, the first and second sets of support bands, and being attached to the building structural roof elements, a first band of the second set of lateral support bands, next adjacent the first rafter, comprising a safety band and being spaced from the first rafter by a distance of 12 inches to 23 inches, such that when, a 400 pound bag, 30 inches diameter, is dropped such that an edge of the bag is close to said first rafter at impact, the force of the impact is transferred to a downward movement of the safety band whereby downward movement of the fabric is lessened, compared to a system where said safety band is six inches from said first rafter, such that the fabric is not cut by said first rafter, and having at least one of (i) a yield strength of 45 ksi to 85 ksi, or (ii) a tensile strength of 60 ksi to 90 ksi, or (iii) an elongation of 12 percent to 40 percent, the safety band extending from the ridge to the eave under each of the intermediate purlins, and being anchored attached, for restraint of longitudinal movement of the safety band, only at opposing first and second ends of the safety band, whereby the amount of the force of a falling such 400 pound bag which must be dissipated by any one member of the fall protection system is reduced, compared to a system wherein the safety band is anchored to each said intermediate purlin crossed by said safety band, a safety clip being anchored attached to each of the intermediate purlins, the safety clip, at a given purlin, either alone or in combination with the intermediate purlin, defining an opening through the safety clip at or adjacent the given intermediate purlin, the safety band extending through said opening, wherein sides of said opening confine the safety band in said opening against substantial transverse movement of the safety band while accommodating generally unrestricted longitudinal movement of the safety band through the opening.

27. A method as in claim 26 wherein the safety band is spaced from the first rafter by a distance of 14 inches to 18 inches.

28. A method as in claim 26 wherein the safety band is spaced from the first rafter by a distance of 15 inches to 17 inches.

29. A method as in claim 26 comprising said safety band having (i) a yield strength of 51 ksi to 64 ksi, and (ii) a tensile strength of 65 ksi to 78 ksi, and (iii) an elongation of 22 percent to 37 percent, and (iv) Rockwell B hardness of 64 to 79.

30. A method as in claim 26 comprising said safety band having (i) an average yield strength of about 58 ksi, and (ii) an average tensile strength of about 72 ksi, and (iii) an average elongation of about 31 percent, and (iv) an average Rockwell B hardness of about 72.

31. A method as in claim 26, including mounting the safety clips to the intermediate purlins on alternating sides of the safety band.

* * * * *